US008671855B2

(12) United States Patent
Capote et al.

(10) Patent No.: US 8,671,855 B2
(45) Date of Patent: Mar. 18, 2014

(54) APPARATUS FOR TREATING WASTE

(75) Inventors: Jose A. Capote, Hillsdale, NJ (US); Parameswaran Venugopal, Trivandrum (IN); Deepak Shah, Gujarat (IN); Joseph Rosin, Naples, FL (US); Daniel Ripes, Chicago, IL (US); Paresh Mevawala, Surat (IN)

(73) Assignee: PEAT International, Inc., Northbrook, IL (US)

( * ) Notice: Subject to any disclaimer, the term of this patent is extended or adjusted under 35 U.S.C. 154(b) by 190 days.

(21) Appl. No.: 12/826,165

(22) Filed: Jun. 29, 2010

(65) Prior Publication Data

US 2011/0079171 A1 Apr. 7, 2011

Related U.S. Application Data

(60) Provisional application No. 61/270,309, filed on Jul. 6, 2009, provisional application No. 61/270,358, filed on Jul. 6, 2009.

(51) Int. Cl.
*F23G 5/10* (2006.01)

(52) U.S. Cl.
USPC ..... 110/250

(58) Field of Classification Search
USPC ..... 110/250; 219/121.36, 121.37, 121.48, 219/121.38, 121.43, 121.52, 119; 156/345.1; 392/311, 315, 317, 323, 392/326, 329, 331, 334, 338; 201/2.5; 588/311, 900, 901; 48/87
See application file for complete search history.

(56) References Cited

U.S. PATENT DOCUMENTS

| | | | |
|---|---|---|---|
| 3,622,493 | A | 11/1971 | Crusco |
| 3,741,134 | A | 6/1973 | Roberts et al. |
| 3,779,182 | A | 12/1973 | Camacho |
| 3,780,674 | A | 12/1973 | Liu |
| 3,783,167 | A | 1/1974 | Tylko |
| 3,841,239 | A | 10/1974 | Nakamura et al. |
| 3,875,357 | A | 4/1975 | Foster et al. |

(Continued)

FOREIGN PATENT DOCUMENTS

| | | | |
|---|---|---|---|
| BE | 1014965 | A4 | 7/2004 |
| CN | 1179172 | A | 4/1998 |

(Continued)

OTHER PUBLICATIONS

Official Letter and Search Report, dated Mar. 31, 2011, Taiwanese (R.O.C.) Patent Application No. 094108020 (and Translation).

(Continued)

*Primary Examiner* — Kenneth Rinehart
*Assistant Examiner* — David J Laux
(74) *Attorney, Agent, or Firm* — Brinks Gilson & Lione

(57) ABSTRACT

A waste treatment system processes waste upon the application of energy. The system includes a vessel that contains an open space. A waste feed system feeds inorganic and/or organic waste into the open space of the vessel. One or more pairs of electrodes are within the vessel and may be supported above a bottom of the vessel. The electrodes generate energy that heats the vessel's open space, and melts inorganic portions of the waste and gasifies and dissociates organic portions of the waste into elemental components. These elemental components may be reformed into a synthesis gas which may be conditioned and cleaned to recovery a non-hazardous product.

12 Claims, 13 Drawing Sheets

(56) References Cited

U.S. PATENT DOCUMENTS

| | | | | | |
|---|---|---|---|---|---|
| 4,153,527 | A | * | 5/1979 | Greenewald, Jr. | 204/164 |
| 4,181,504 | A | | 1/1980 | Camacho | |
| 4,326,842 | A | | 4/1982 | Adachi et al. | |
| 4,361,441 | A | | 11/1982 | Tylko | |
| 4,438,706 | A | | 3/1984 | Boday et al. | |
| 4,472,172 | A | | 9/1984 | Sheer et al. | |
| 4,479,443 | A | | 10/1984 | Faldt et al. | |
| 4,508,040 | A | | 4/1985 | Santén et al. | |
| 4,615,285 | A | | 10/1986 | Bentell | |
| 4,635,573 | A | | 1/1987 | Santén | |
| 4,644,877 | A | | 2/1987 | Barton | |
| 4,770,109 | A | | 9/1988 | Schlienger | |
| 4,831,944 | A | | 5/1989 | Durand et al. | |
| 4,886,001 | A | | 12/1989 | Chang et al. | |
| 4,896,614 | A | | 1/1990 | Kulkarni | |
| 4,980,092 | A | | 12/1990 | Pineau et al. | |
| 4,989,522 | A | | 2/1991 | Cline et al. | |
| 4,998,486 | A | | 3/1991 | Dighe et al. | |
| 5,010,829 | A | | 4/1991 | Kulkarni | |
| 5,065,680 | A | | 11/1991 | Cheetham | |
| 5,090,340 | A | | 2/1992 | Burgess | |
| 5,095,828 | A | | 3/1992 | Holden et al. | |
| 5,108,708 | A | | 4/1992 | Hanus | |
| 5,127,347 | A | | 7/1992 | Cheetham | |
| 5,134,946 | A | | 8/1992 | Poovey | |
| 5,143,000 | A | | 9/1992 | Camacho | |
| 5,206,879 | A | | 4/1993 | Moody et al. | |
| 5,222,448 | A | | 6/1993 | Morgenthaler et al. | |
| 5,280,757 | A | | 1/1994 | Carter et al. | |
| 5,319,176 | A | | 6/1994 | Alvi et al. | |
| 5,363,781 | A | | 11/1994 | Chang et al. | |
| 5,399,833 | A | | 3/1995 | Camacho | |
| 5,451,738 | A | | 9/1995 | Alvi et al. | |
| 5,497,710 | A | | 3/1996 | Camacho | |
| 5,534,659 | A | | 7/1996 | Springer et al. | |
| 5,541,386 | A | | 7/1996 | Alvi et al. | |
| 5,544,597 | A | | 8/1996 | Camacho | |
| 5,586,140 | A | | 12/1996 | Ishida et al. | |
| 5,606,925 | A | | 3/1997 | Boen et al. | |
| 6,015,963 | A | * | 1/2000 | Flannery et al. | 110/246 |
| 6,021,723 | A | | 2/2000 | Vallomy | |
| 6,153,158 | A | | 11/2000 | Flannery et al. | |
| 6,153,852 | A | | 11/2000 | Blutke et al. | |
| 6,155,182 | A | | 12/2000 | Tsangaris et al. | |
| 6,173,002 | B1 | | 1/2001 | Robert | |
| 6,182,585 | B1 | | 2/2001 | Gonopolsky et al. | |
| 6,215,678 | B1 | | 4/2001 | Titus et al. | |
| 6,222,153 | B1 | | 4/2001 | Wald | |
| 6,250,236 | B1 | | 6/2001 | Feizollahi | |
| 6,355,904 | B1 | | 3/2002 | Batdorf et al. | |
| 6,380,507 | B1 | | 4/2002 | Childs | |
| 6,388,226 | B1 | | 5/2002 | Smith et al. | |
| 6,514,469 | B1 | | 2/2003 | Kado et al. | |
| 6,551,563 | B1 | | 4/2003 | Kado et al. | |
| 6,576,807 | B1 | | 6/2003 | Brunelot et al. | |
| 6,630,113 | B1 | * | 10/2003 | Surma | 422/199 |
| 6,645,438 | B1 | | 11/2003 | Dubrovsky | |
| 6,763,772 | B2 | | 7/2004 | Gnedenko et al. | |
| 6,781,087 | B1 | | 8/2004 | Chism et al. | |
| 6,810,821 | B2 | * | 11/2004 | Chan | 110/250 |
| 6,817,388 | B2 | * | 11/2004 | Tsangaris et al. | 110/252 |
| 7,216,593 | B2 | | 5/2007 | Capote et al. | |
| 2002/0192030 | A1 | | 12/2002 | Almeida | |
| 2003/0024806 | A1 | | 2/2003 | Foret | |
| 2003/0048828 | A1 | | 3/2003 | Titus | |
| 2003/0167983 | A1 | | 9/2003 | Gnedenko et al. | |
| 2004/0159366 | A1 | | 8/2004 | Tsangaris et al. | |
| 2005/0070751 | A1 | | 3/2005 | Capote et al. | |
| 2005/0120578 | A1 | | 6/2005 | van der Meulen | |
| 2005/0204969 | A1 | | 9/2005 | Capote et al. | |
| 2007/0199485 | A1 | | 8/2007 | Capote et al. | |
| 2007/0289509 | A1 | | 12/2007 | Vera | |
| 2008/0097137 | A1 | | 4/2008 | Chapman et al. | |
| 2008/0147241 | A1 | | 6/2008 | Tsangaris et al. | |

FOREIGN PATENT DOCUMENTS

| | | | | |
|---|---|---|---|---|
| CN | 2527371 | Y | | 12/2002 |
| CN | 1388764 | A | | 1/2003 |
| CN | 1425873 | A | | 6/2003 |
| CN | 2663526 | Y | | 12/2004 |
| CN | 1683828 | A | | 10/2005 |
| CN | 1300506 | C | | 2/2007 |
| CN | 200945492 | Y | | 9/2007 |
| CN | 101088581 | A | | 12/2007 |
| CN | 100500339 | C | | 6/2009 |
| CN | 101457934 | A | | 6/2009 |
| EP | 0330872 | | | 9/1989 |
| EP | 0 469 737 | A2 | | 2/1992 |
| JP | 56146919 | A | * | 11/1981 |
| TW | 2055899 | | | 5/1993 |
| TW | 577966 | | | 3/2004 |
| TW | 2008-00327 | A | | 1/2008 |
| TW | 2008-17501 | A | | 4/2008 |
| WO | WO 01/53434 | A | | 7/2001 |
| WO | WO 01/79774 | A | | 10/2001 |
| WO | WO 01/92784 | A1 | | 12/2001 |
| WO | WO 03/069227 | A1 | | 8/2003 |

OTHER PUBLICATIONS

Extended European Search Report, dated Mar. 10, 2011, Patent Application No. 07709771.5 (and Abstract).

International Search Report and Written Opinion of the International Searching Authority for PCT/US2010/040355 dated Oct. 8, 2010.

International Search Report for PCT Application No. PCT/2005/007904.

International Search Report for PCT Application No. PCT/US2004/031310.

Rutberg, "Plasma pyrolysis of toxic waste", Plasma Phys. Control Fusion, vol. 45, pp. 957-969.

Scope of Supply, Terms and Conditions, and Notice to Proceed regarding NCKU PTDR System.

Rutberg et al., "The Technology and Execution of Plasmachemical Disinfection of Hazardous Medical Waste", IEEE Transactions on Plasma Science, vol. 30, No. 4, pp. 1445-1448.

Rutberg, "Some plasma environmental technologies developed in Russia", Plasma Sources Sci. Technol., vol. 11, pp. A159-A165.

Fauchais et al., "Thermal Plasmas", IEEE Transactions on Plasma Science, vol. 25, No. 6, pp. 1258-1280.

Municipal Solid Waste Feasibility of Gasification with Plasma ARC, Environmental Analyses, presented to EPRI Symposium Industrial Applications of Plasma, Palo Alto, CA.

Reference regarding PLASCON™ system.

Examination Opinion dated Dec. 3, 2012, for Taiwanese Patent Application No. 099121588.

First Office Action dated Jan. 21, 2013, for Chinese Patent Application No. 201010225839.7.

Examination Opinion and Prior Art Search Report from the Taiwanese Intellectual Property Office re Application No. 0991212558, dated Jun. 26, 2013. (Translation).

* cited by examiner

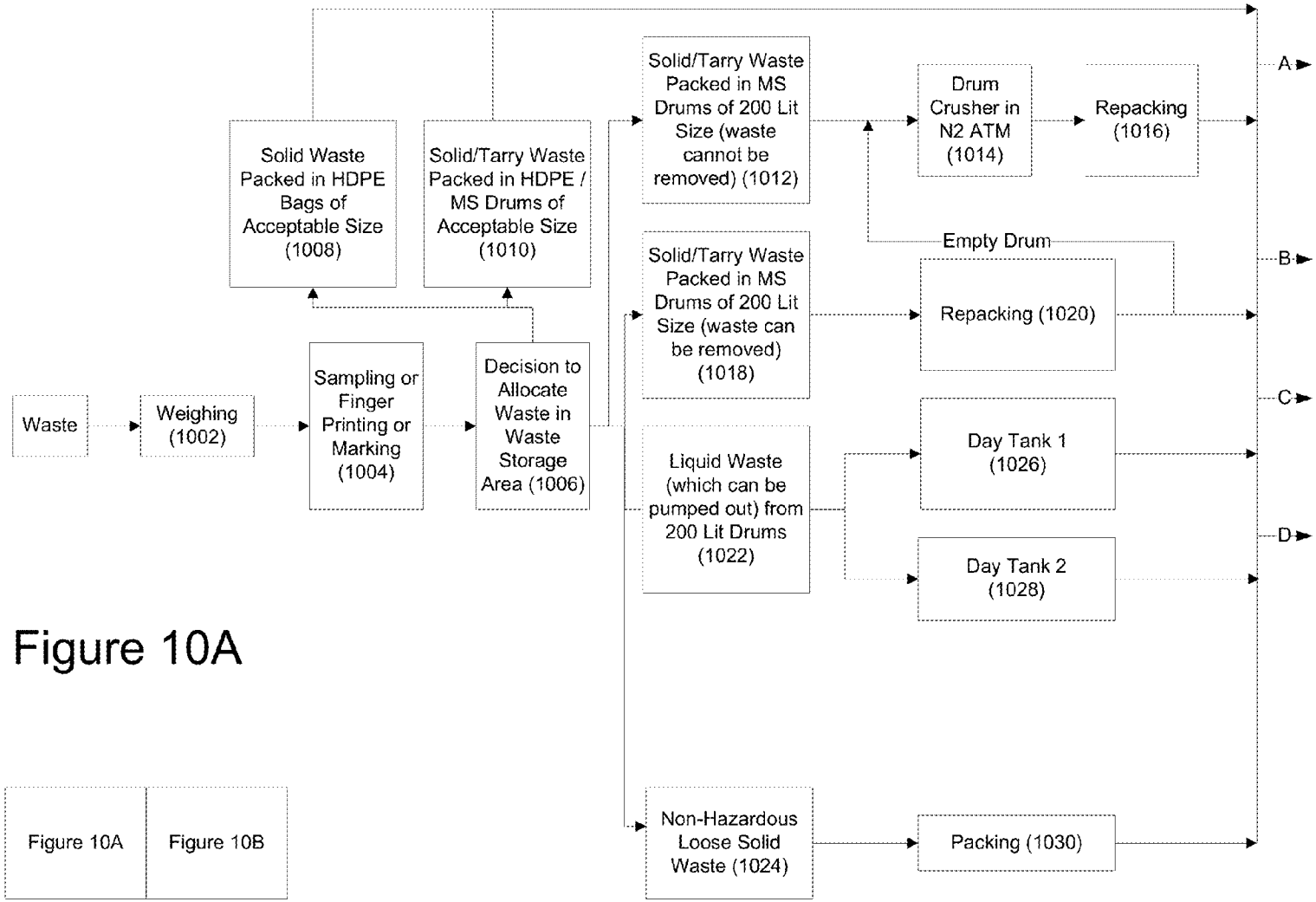
A
B
C
D
Repacking (1016)
Drum Crusher in N2 ATM (1014)
Empty Drum
Repacking (1020)
Day Tank 1 (1026)
Day Tank 2 (1028)
Packing (1030)
Solid/Tarry Waste Packed in MS Drums of 200 Lit Size (waste cannot be removed) (1012)
Solid/Tarry Waste Packed in MS Drums of 200 Lit Size (waste can be removed) (1018)
Liquid Waste (which can be pumped out) from 200 Lit Drums (1022)
Non-Hazardous Loose Solid Waste (1024)
Solid/Tarry Waste Packed in HDPE / MS Drums of Acceptable Size (1010)
Decision to Allocate Waste in Waste Storage Area (1006)
Solid Waste Packed in HDPE Bags of Acceptable Size (1008)
Sampling or Finger Printing or Marking (1004)
Weighing (1002)
Waste
Figure 10A
Figure 10A
Figure 10B

APPARATUS FOR TREATING WASTE

PRIORITY CLAIM

This application claims the benefit of priority from U.S. Provisional Application No. 61/270,309, filed Jul. 6, 2009, and U.S. Provisional Application No. 61/270,358, filed Jul. 6, 2009, both of which are incorporated by reference.

BACKGROUND OF THE INVENTION

1. Field of the Invention

This disclosure relates to the treatment of waste material and, more particularly, to the controlled thermal destruction of hazardous and non-hazardous materials.

2. Background

Waste material may be in solid, semi-solid, or liquid form, and may include organic and/or inorganic material. Some solid waste materials have been disposed in landfills. However, public opposition and regulatory pressures may restrict some landfill practice. Other solid and some liquid waste materials have been disposed of through combustion and/or incineration. These processes may produce substantial amounts of fly ash (a toxic constituent) and/or bottom ash, both of which by-products require further treatment. Additionally, some combustion and/or incineration systems suffer from the inability to maintain sufficiently high temperatures throughout the waste treatment process. In some systems, the lower temperature may result from the heterogeneity of the waste materials. In other systems, the reduced temperature may result from the varying amount of combustible and non-combustible material and/or moisture within an incinerator. As a result of the lower temperatures, and other factors such as the need for excess air and supplementary fossil fuels to maintain proper combustion, these incineration systems may generate hazardous materials which may be released into the atmosphere.

SUMMARY

A waste treatment system processes waste upon the application of energy. The system includes a vessel that contains an open space. A waste feed system feeds inorganic and/or organic waste into the open space of the vessel. One or more pairs of electrodes are within the vessel and may be supported above a bottom of the vessel. The electrodes generate energy that heats the vessel's open space, and melts inorganic portions of the waste and gasifies and dissociates organic portions of the waste into elemental components. These elemental components may be reformed into a synthesis gas which may be conditioned and cleaned to recovery a non-hazardous product.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

FIGS. 10A and 10B are an alternate flow diagram for feeding waste to a waste treatment system.

DETAILED DESCRIPTION OF THE PREFERRED EMBODIMENTS

Figure 1:
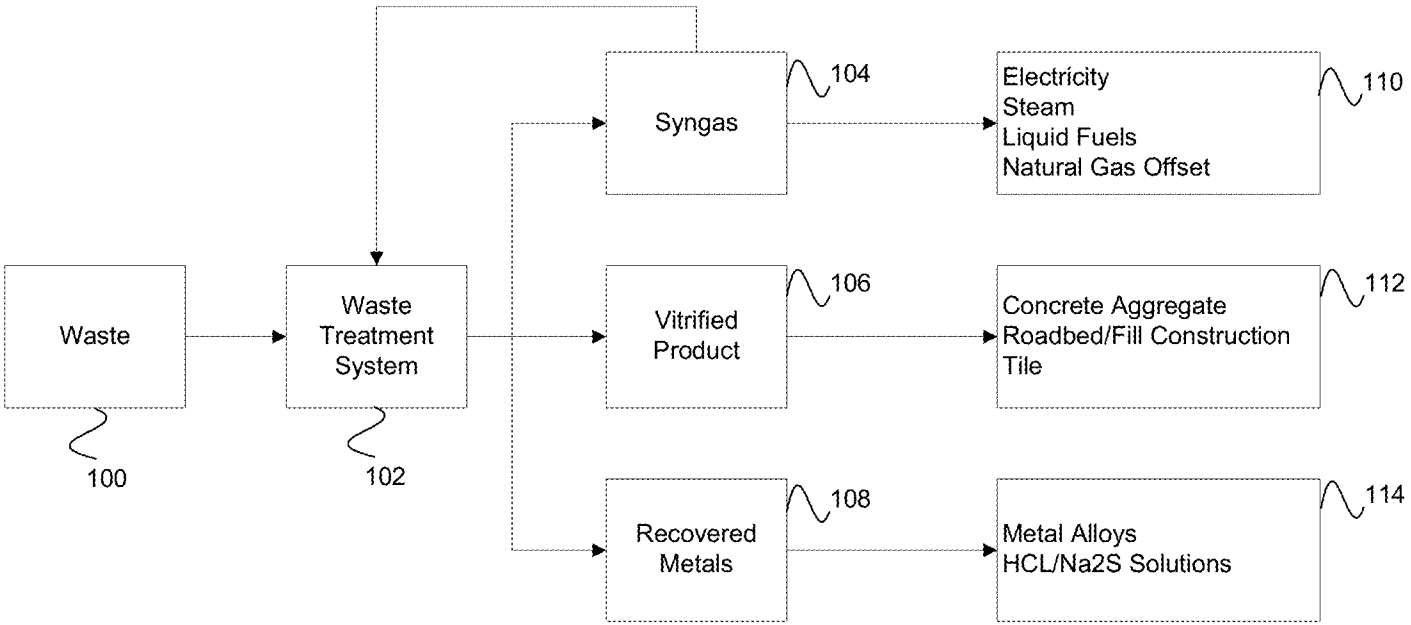
FIG. 1 is a flow process of a waste treatment process.

A waste treatment system processes waste through the application of energy. The system may receive and treat inorganic and/or organic solid waste, semi-solid waste, slurry and/or tarry waste, and or liquid waste. FIG. 1 is a flow chart of a waste treatment process. In FIG. 1, waste 100 is fed into the waste treatment system 102. The waste treatment system 102 uses heat in an oxygen starved (e.g., pyrolysis/gasification) environment to dissociate the molecules that make-up organic portions of the waste. Depending on the composition of the waste, a controlled amount of oxygen may be added to the dissociated molecules to reform the dissociated elements of the waste into a synthesis gas ("syngas") 104. The syngas may substantially consist of carbon monoxides and hydrogen, however, other elements may be included in the syngas as well. The syngas may be used in a variety of ways: as a fuel for thermal and/or electricity production, as a feedstock for the production of liquid fuels, such as ethanol, or as a natural gas offset 110.

Inorganic constituents of the waste are melted or vitrified into an environmentally safe vitrified product 106 and/or molten metal 108. The vitrified product 106 and the molten metal 108 may be removed from the waste treatment system 102 through a controllable collection system. The recovered vitrified product 106 may be recycled as concrete aggregate, roadbed/fill construction, tiles, or for other applications 112. The recovered metal 108 may be recycled as part of metal alloys, $HCl/Na_2S$ solutions, or as part of other applications 114.

To process the waste, the waste treatment system 102 may include one or more pairs of electrodes within an electrode holding apparatus that is within a processing vessel and elevated above an area where slag is retained in the vessel. Depending on the waste to be treated and the desired size of the system, the waste treatment system may have different configurations and may process gas generated in the vessel differently.

Figure 2:
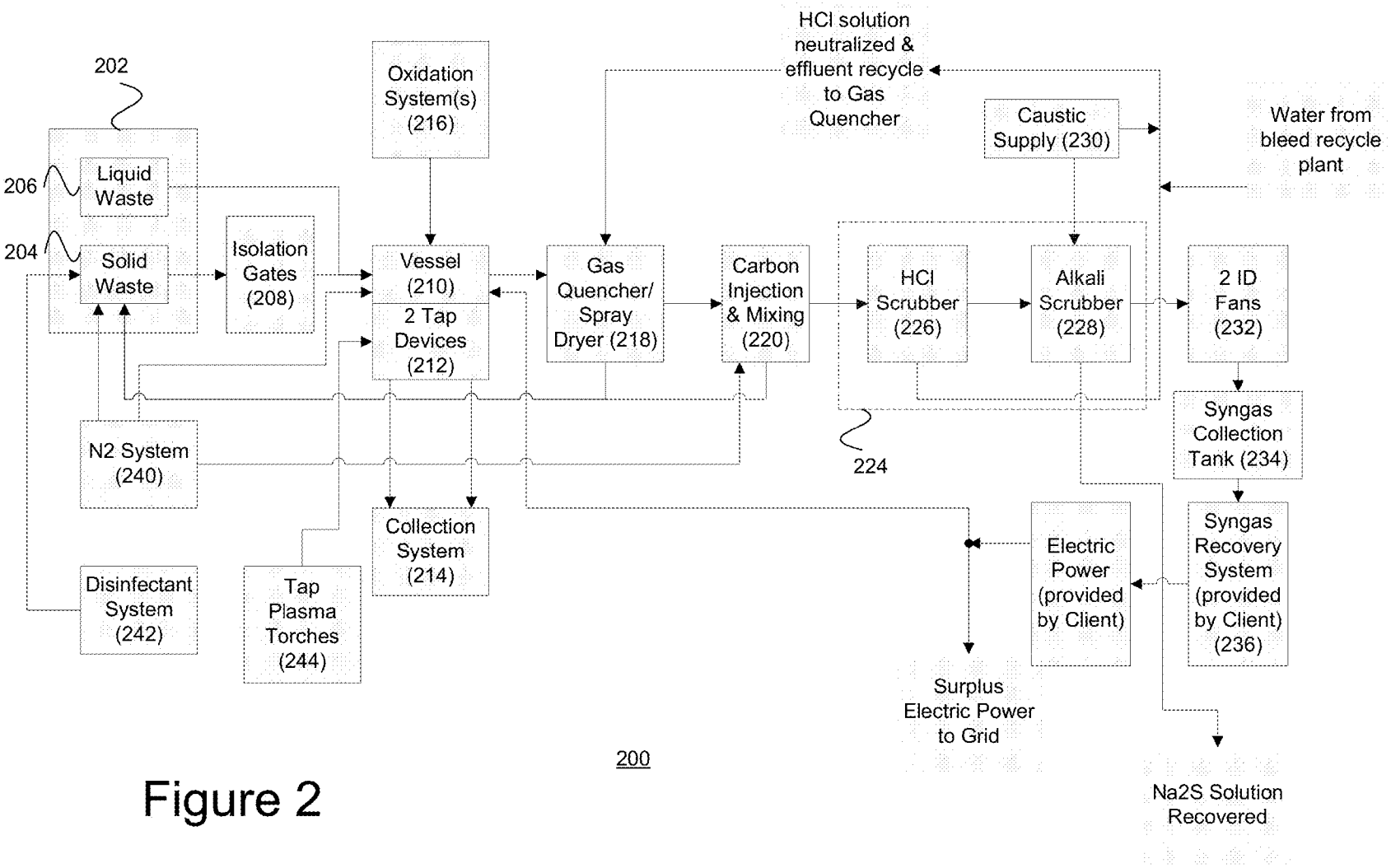
FIG. 2 is a diagram of a waste treatment system.

FIG. 2 is a diagram of a waste treatment system. The waste treatment system 200 may include a processing chamber or vessel 210 having an open space in which waste may be processed. The vessel 210 may be coupled to a waste feed system 202. The waste feed system 202 may include a solid waste feed system 204 and/or a liquid waste feed system 206. In some systems 200, the solid waste feed system 204 may include a compressible and/or non-compressible feed system. A compressible feed system may include a mechanical or hydraulically operated screw feed. The screw feeder may be used to shred, crush, or compress solid and/or semi-solid waste for processing in the vessel 210. A heat exchanger may be coupled with the hydraulically operated screw feed to heat or cool a lubricating liquid used to maintain operation of the hydraulic screw feed. The non-compressible feed system may be a gravity feed system. The gravity feed system may include a feeding chamber or tube that leads to the vessel 210 and may be used with wastes that cannot be shredded, crushed, or compressed. Additionally, either of the compressible or non-compressible feed systems may be used to feed powder wastes to the vessel 210.

The compressible feed system may include a feeding chamber that is positioned at an inclined angle. In some systems 200, this inclined angle may vary between approximately 10 degrees from the horizontal to approximately 15 degrees from the horizontal. In other systems, the inclined angle may be smaller or larger than this approximate range, but may be inclined to a point where gravity assists with feeding waste and draining liquids that may have been extruded or leaked from waste packages from the feeding chamber into the vessel 210.

In FIG. 2, it is shown that the solid waste feed system (e.g., the compressible and/or non-compressible feed systems) is separated from the vessel 210 by an isolation gate system 208. The isolation gate system 208 may include two retractable isolation gates for each feed system present. A first isolation gate may be positioned proximate to a feeding hopper to permit feeding of waste feedstock into a feeding chamber of the solid waste feed system 204. A second isolation gate may be positioned proximate to the vessel 210 and may permit the feeding of the waste feedstock into the vessel 210. The solid waste feed system 204 may be controlled by a waste treatment system computer, such that only one isolation gate is open at a time. In some systems, a sensor may monitor the quantity of feedstock being introduced into the solid waste feed system 204. After the first isolation gate closes, nitrogen may be introduced into the feeding chamber through one or more openings and/or nozzles. The nitrogen may be used to pressurize the feeding chamber to substantially reduce and/or prevent air from entering the vessel 210 with the waste feedstock, and to substantially prevent the potential for back-flow of combustible synthesis gas (e.g., gas generated by the treatment of waste in the vessel 210; also referred to as "syngas") from the vessel 210. In some systems, a nitrogen system 240 may supply nitrogen to the solid waste feed system 204, the vessel 210, and/or other downstream components. The nitrogen may be supplied as a nitrogen "dump" into the feeding chamber whenever there is an emergency shut-down of the system as a safety feature to prevent back-flow of combustible gases. Alternatively, the nitrogen "dump" may be introduced directly into the vessel 210. In some systems 200, the nitrogen system may have a capacity of about 150 $Nm^3$/hr. In other smaller systems, the nitrogen system 240 may have a capacity of about 25 $Nm^3$/hr to about 50 $Nm^3$/hr.

To help minimize and/or prevent the generation and/or release of toxic or hazardous materials from the solid waste feeding chamber when waste is received, a disinfectant system 242 may introduce a disinfectant solution into the solid waste feed feeding chamber through an opening. In some systems, the opening may be the hopper that receives waste prior to entry into the feeding chamber. The received disinfectant may disinfect the feeding chamber and any excess solution may be drained into the vessel 210 and be processed as waste. In other systems, the disinfectant may be introduced through one or more nozzles positioned along a path of the solid waste feed feeding chamber.

The waste treatment system is versatile in that it may process various types of waste. In some instances, the solid waste feed system 204 may be used to charge the vessel 210 with waste feedstock such as municipal solid waste, polychlorinated biphenyls ("PCB") contaminated materials, refinery waste, office waste, cafeteria waste, facilities maintenance waste (e.g., wooden pallets, oil, grease, discarded light fixtures, yard waste, wastewater sludge), pharmaceutical waste, medical waste, fly and bottom ash, industrial and laboratory solvents, organic and inorganic chemicals, pesticides, organo-chlorides, thermal batteries, post-consumer batteries, and military waste, including weapon components. Depending on the design of the system, the solid waste feed system 204, may have approximately 600 mm clearance between each of its isolation gates. With this configuration, the solid waste system 204 may process waste that is about 400 mm in length. Waste exceeding this length may be preprocessed on or off-site prior to it being processed by the waste treatment system. In other systems, the amount of clearance and length of waste that may be processed may vary from these approximations.

A liquid waste (e.g., solvent waste) feed system, such as the solvent waste feed system disclosed in U.S. patent application Ser. No. 10/673,078, filed Sep. 27, 2003, and published on Mar. 31, 2005, as U.S. Published Application No. 2005/0070751, now abandoned, which is incorporated by reference herein, may provide liquid waste to the vessel 210. Solvent waste may be pumpable waste that may pumped from a storage drum, storage tank, and/or retaining pool. Some liquid waste materials may be provided to the vessel 210 through a feeding chamber, such as one included with the solid waste feed system 204. Alternatively, liquid waste may be injected directly into the vessel 210 through one or more nozzles positioned around a portion of the vessel 210. The liquid waste feed system 206 may feed liquid waste into the vessel 210 through one or more nozzles from one or more waste sources in an alternating manner, a sequential manner, or at substantially the same time. The nozzles used to introduce the liquid waste into the vessel 210 may be water-cooled spray nozzles. In some waste treatment systems 200, the liquid waste fed through multiple solvent waste feed nozzles may comprise different types of waste. For example, the solvent waste received from one manufacturing process may be introduced through one nozzle, and solvent waste of a different composition received from a different manufacturing processing may be introduced through another nozzle. The number of solvent waste feed nozzles used, and the manner in which they are employed may vary based upon design and/or application.

Some or all of the solvent waste feed nozzles may be configured to substantially maximize the surface area of the solvent waste. In some designs, this may be accomplished by generating substantially micro-droplets. By substantially maximizing the surface area of the droplet, energy within the vessel 210 may be transferred to the droplets at a substantially greater rate than droplets having a reduced surface area. Maximizing the surface area of the solvent waste droplets may be accomplished by mixing compressed air with the solvent waste in the nozzle. In some systems, liquid waste may be fed into the vessel at a rate of 1,000 kg/hr. In other smaller systems, liquid waste may be fed into the vessel at a rate of 250 kg/hr.

Solid and liquid waste may be treated separately or at substantially the same time. To process the waste separately, the solid and liquid waste are separately introduced into the vessel 210. To process the waste at substantially the same time, the solid and liquid waste are introduced into the vessel 210 at substantially the same time or substantially subsequent to one another, such that both solid and liquid waste are in the vessel 210 at a similar time. When the solid and liquid waste are processed at substantially the same time, liquid waste may be introduced into the solid waste feed system 204 to create a homogeneous mix of solid and liquid waste. Alternatively, liquid waste may be introduced into the vessel 210 through the solvent waste feed system 206 at substantially the same time that solid waste is introduced into the vessel 210 through the solid waste feed system 204. The waste treatment system 200 may process equal or non-equal portions of solid and liquid waste.

The desired rate at which waste is fed into the vessel 210 may be dependent on various factors, such as the characteristics of the waste; the energy available from a heating system versus the energy expected to be required for the completion of a molecular dissociation, pyrolysis, and a gasification and melting process; the expected amount of syngas to be generated versus the design capacity of a gas cleaning and conditioning system; and/or the temperature and/or oxygen conditions within the vessel 210. The feed rate may be initially calculated based on: an estimation of the energy required to process the specific waste type being treated, an estimation of the energy required to process the specific waste type being treated, an estimation of the expected quantity of syngas to be produced versus the limitation imposed by the physical size of the plasma reactor (e.g., maintaining a desired residence time in the plasma reactor), or limitations regarding the design capacity of a downstream scrubber system.

Waste fed into the open space of the vessel 210 may be processed by a heating system. The heating system may be positioned within the vessel 210. The heat system may include an electrode holding assembly. The electrode holding assembly may be positioned at the bottom of the vessel 210 such that torch electrodes are elevated compared to the remainder of the vessel 210 bottom and, thus, elevated above a slag pool that may form at the bottom of the vessel 210. The electrode holding assembly may be constructed with insulated material to help transfer heat generated within the electrode holding assembly to the open space of the vessel 210.

The electrode holding assembly may house one or more pairs of graphite electrodes. In some systems, the electrode holding assembly may house three pairs of graphite electrodes. In these systems, each pair of electrodes may comprise an anode and a cathode that may transfer an arc between them. Each of the pairs of electrodes may have a capacity of approximately 400 kilowatts. In smaller systems, the electrode holding assembly may house a single pair of graphite electrodes. In these systems, the pair of electrodes may comprise an anode and cathode that may transfer an arc between them to generate approximately 400 kilowatts.

Inorganic constituents in the waste may be vitrified or melted in the vessel 210. The vitrified or melted inorganic constituents may be removed from the vessel 210 through tap ports 212 and a tapping process. During non-tapping operations, the tap ports 212 are closed using water-cooled tap plugs. When tapping is to be initiated, a tap plug is removed from the tap ports 212 permitting a molten vitrified mixture to flow out of the vessel 210 through the tap ports 212 and into a collection system 214. To assist with the removal of the molten vitrified mixture, a non-transferred, water-cooled, direct current plasma torch 244 may be mounted with the vessel 210 near each tap port 212. These plasma torches 244 may be mounted such that an end of the plasma torch 244 passes into the opening of the vessel 210. The plasma plumes of the plasma torches 244 may be directed towards the bottom area of the vessel 210 near the tap ports 212. The plasma torches may be computer controller and may be operated periodically to maintain the fluidity of the molten vitrified material.

In some systems 200, the tapping plasma torches 244 may have a capacity of about 15 kilowatts each. The tapping plasma torches 244 may be positioned at an inclined angle with respect to a wall of the vessel 210, and through the refractory. A water cooled metal enclosure may house the electrodes of the tapping plasma torches. Cooling water for the tapping plasma torches may be supplied from an insulated gate bipolar transistor (IGBT) power supply cooling system positioned downstream in the system. In some systems, the tapping plasma torches may use nitrogen as a torch gas.

The collection system 214 may include a continuous quenching system that would receive the molten vitrified material that flows out of the tapping ports 212. The small amount of steam generated by the molten vitrified material may be captured by activated carbon beds that are vented to the outside. The collection system 214 may also include buckets that would receive the molten vitrified material. Once full, these buckets may be placed inside a quenching tank. Handling of the filed buckets may be accomplished through the use of floor mounted cranes, overhead mounted cranes, forklifts, and/or other lifting apparatuses. The cooled buckets may be removed, and the cooled vitrified material removed and recycled as necessary. When an activated carbon bed of the collection system 214 is spent, the spent bed may be recycled through the vessel 210.

In some systems 200, the temperature and/or pressure in the vessel 210 may be continuously or substantially continuously monitored to ensure that negative pressure in the vessel 210 is within a predetermined range. Monitoring of the temperature and/or pressure in the vessel 210 may be through one or more monitoring ports positioned around the vessel 210, and may include the use of one or more sensors in communication with a computerized control system. In some vessels 210, the predetermined negative pressure may range between about −5 mm W.C. (water column) to about −10 mm W.C.

The temperature in the vessel 210 may be measured from at least two locations. One location may be in an upper section of the vessel 210, and a second location may be in a lower section of the vessel 210. The electrodes are operated without waste feed until the vessel 210 reaches a minimum temperature of about 1,000 degrees Celsius. This will help to ensure proper dissociation, pyrolysis, and gasification of the organic wastes. Once feeding operations commence, the temperature of the vessel 210 may be increased to a range between approximately 1,000 degrees Celsius to about 1,200 degrees Celsius. The temperature in the vessel 210 may continue to increase during operation, and may approach approximately 1,500 degrees Celsius when vitrification or melting operations commence.

The heating system may have an electrical-to-thermal efficiency greater than about 75 percent, and may not require a pressurized external supply of carrier gas. The system may supply its own gas flow—approximately 5 liters per minute of air per electrode assembly. This small flow of air may also enhance the thermal energy distribution within the vessel 210. The electrode arcs are powered by an insulating gate bipolar transistor (IGBT) power supply. The IGBT power supply may use an input current that is approximately 30 percent less than a silicon controller rectifier system. The IGBT power supply may result in: power factors that are in the range of about 0.97, low harmonic distortion, high arc stability, and/or a smaller control panel.

As a result of the low oxygen environment in the vessel 210, waste received in the vessel 210 may undergo a molecular dissociation and pyrolysis process. Pyrolysis is a process by which intense heat operating in an low oxygen environment dissociates molecules, as contrasted with incineration or burning. During the pyrolysis process, the waste is heated by the heating system. The heated organic waste may be processed until is dissociates into its elemental components, such as solid carbon (carbon particulate) and hydrogen gas. Oxygen, nitrogen, and halogens (such as chlorine) may also be liberated if present in the waste in the form of a hydrocarbon derivative. After pyrolysis and/or partial oxidation, a resulting syngas including carbon monoxide, hydrogen, carbon dioxide, water vapor, methane, and/or nitrogen may be generated.

In general, dissociated oxygen and chlorine may react with carbon and hydrogen to form a wide array of complex and potentially hazardous organic compounds. Such compounds, however, generally cannot form at the high temperatures within the vessel 210, at which only a limited number of simple compounds may be stable. The most common and stable of these simple compounds are carbon monoxide (formed from a reaction between the free oxygen and carbon particulate), diatomic nitrogen, hydrogen gas, and hydrogen chloride gas (as representative of a hydrogen-halogen gas), when chlorine or other halogens are present.

The amount of oxygen present in the waste material may be insufficient to convert all of the carbon present in the waste material into carbon monoxide gas. Moisture present in the waste material may absorb energy from the high temperature environment in the vessel 210 through a "steam-shift" reaction and form carbon monoxide and hydrogen gas. If an insufficient amount of oxygen or moisture is present in the waste stream and/or as a result of inherent process inefficiencies, unreacted carbon particulates may be entrained in the gas stream and carried out of the vessel 210.

To increase the amount of solid carbon converted to carbon monoxide gas, an additional oxidant may be introduced into the vessel 210. The addition of this oxidant may be into a primary reaction chamber of the vessel 210 and/or, when present, a secondary reaction chamber of the vessel 210. The waste processing system 200 may include an oxidant system 216 that injects an oxidant into the vessel 210 in an amount that facilitates a conversion of some or a substantial portion of the carbon or carbon particulate in the vessel 210 to carbon monoxide. In some systems, the oxidant injection system 216 may be a pressure swing absorption system. The pressure swing absorption system may include a screw air compressor, molecular sieve column, storage tanks, and a local control panel. In some systems, the pressure swing absorption system may have a capacity of about 100 $Nm^3$/hr to about 400 $Nm^3$/hr. In other smaller systems, the pressure swing absorption system may have a capacity of about 100 $Nm^3$/hr. The oxidant injection system 216 may also include oxygen lances to inject additional oxygen into the vessel 210. The oxygen lances may be mounted to the vessel 210, and may inject into the vessel 210 oxygen with a purity in the range of about 90 percent to about 93 percent. Predetermined amounts of the oxidant may be injected into the vessel 210 at one or more locations.

The oxidant injected into the vessel 210 may convert some or a substantial portion of the carbon in the waste or carbon that is dissociated in the vessel 210 as free carbon into carbon monoxide. Because pure carbon is more reactive at the high operating temperatures than the carbon monoxide gas, the additional oxygen may react with the carbon to form carbon monoxide, and not with the carbon monoxide to form carbon dioxide (assuming that the oxidant is not added in excess).

The syngas leaving the vessel 210 may pass through pipes/ductwork and be processed by a gas quencher and spray drying system 218. Upon entering the gas quencher and spray drying system 218, the syngas may be at a high temperature. In some waste treatment systems 200, this temperature may be between approximately 1,000 degrees Celsius and approximately 1,200 degrees Celsius. However, in other systems, the temperature may be higher or lower. The spray drying system may include a stream of scrubber bleed liquid and/or a cooling tower blowdown (that may be recycled into the vessel 210 instead of being discharged), which may be an aqueous liquid waste with a flow rate of approximately 1,400 kg/hr that can be atomized using a small amount of pressurized nitrogen. In other smaller systems, the aqueous liquid waste may be provided by the spray drying system at a flow rate of approximately 350 kg/hr.

The recycled waste water cools the gas to a temperature of approximately 220 degrees Celsius. Heavy solids that were entrained in the syngas are collected at the bottom of the gas quencher and spray drying system 218. Collection of the heavy solids may be achieved with a rotary air lock valve. For example, solids may be removed through a rotary valve arrangement and may then fall through a slide gate into a hopper that may have a capacity of about 1 $m^3$. In some cases, and depending on the type of waste being processed, sodium carbonate or a lime solution may be injected into the gas stream to help reduce the acid content of the syngas and thus reduce the burden of a polishing scrubber downstream.

A solids detector could be added to the hopper to transmit data back to a computerized waste treatment computer providing an indication of when the hopper needs to be emptied. When emptying the hopper, the slide gate in the gas quencher may be closed and a slide gate of the hopper may be opened and emptied into a collection cart. The contents of the cart may then be emptied into bags or drums for storage and may be recycled by processing them through the solid waste feed system 204. A load cell sensor may be provided in the bottom of the cart. This load cell sensor may detect how much solid waste was collected from the gas quencher and spray dryer system 218. The load cell sensor may transmit the collected data through a wire or wireless system to the waste treatment computer.

In some systems 200, the gas quencher water may be supplied from a tank system with a redundant hot standby pump. The gas quencher tank system may have a capacity of approximately 1,000 liters. An emergency fresh water supply may be provided for use in case of an off-normal operating condition (e.g., loss of on-site power). The gas quencher and spray dryer system 218 may also utilize aqueous liquid inorganic wastes from any neighboring client's existing facilities thus providing potential added benefits to neighboring companies to reduce the volume of discharged liquid wastes from other client facility operations.

The cooled syngas from the gas quencher and spray dryer system 218 then flows to an activated carbon injection and mixing system 220. The system 220 consists of a storage hopper having a capacity of about 1 $m^3$, an activated carbon feeder, and a baghouse. A predetermined amount of powdered activated carbon may be metered through a variable speed screw conveyor. The predetermined amount of powdered activated carbon may vary depending on the waste composition, but some systems use about 0.2 percent by weight of the gas flow. The speed of the conveyor may be varied depending on how the carbon is to be injected into the system. The powdered activated carbon may be injected into the ductwork of the system 220, at a location that is near to the gas quencher and spray dryer system 218 exit in order to allow more time before the syngas enters the baghouse.

During operation of the waste treatment system 200, it may be necessary to replenish the carbon for the mixing system 220. Replenishment may be accomplished by bringing bags containing activated carbon to a bag dumping station that is part of the mixing system 220. A station door at the mixing system 220 may be opened, under which there may be a mesh deck. After placing the bags containing the activated carbon on the mesh deck, the bags may be opened by an operator, and the contents emptied into a hopper. Activated carbon may be added until a sensor detects that the hopper is sufficiently full. Once the hopper is at a sufficiently filed level, the station door is closed, and a nitrogen purge commences. Upon completion of the nitrogen purge, the mixing system feeder may begin feeding the carbon into the ductwork.

The syngas and powdered activated carbon passes into a baghouse (e.g., fabric filter). The syngas, containing particulate and acid gas constituents, strikes baffle plates which distribute the gas substantially uniformly through the baghouse and drops heavy particulate into a baghouse hopper. The syngas may then continue to flow upward into a bag module. Particulate is filtered from the unrefined syngas as it flows from the outside of a filter bag in the baghouse, across the filter bag media, and to the inside of the filter bag.

To maintain a moderate pressure drop, the baghouse filter bags may be cleaned by pulsing nitrogen gas through them. The pulsed gas delivers a momentary pulse of high pressure nitrogen down through the inner bag surface. The pulsed nitrogen expands the bag and dislodges any dust cake residing in the filter bags. The dust cake may fall downwards into the baghouse hopper where it may be collected and recycled into the vessel 210. Cleaning of the bag house filters may occur on a row-by-row basis, therefore only a fraction of the total filter gas is interrupted for cleaning. The row-by-row cleaning allows for continuous filtration without modules being taken off-line. The frequency and the duration of the nitrogen gas pulses may be preset or adjusted by an operator.

The baghouse may include Teflon lined bags and stainless steel 304 bag cages. The baghouse may include redundant baghouses that would include common syngas inlet and outlet piping, separate nitrogen purges, redundant temperature and pressure sensors and isolation valving.

The syngas cleaned of particulate matter then flows to a scrubbing system 224. In FIG. 2, the scrubbing system 224 recovers HCl and $Na_2S$ solutions. This configuration may be used for projects where the waste feedstock system contains higher levels of sulfur and/or where the local regulations may prohibit the discharge of scrubber bleed containing $Na_2S$ salts in the range of about 2 percent to about 3 percent.

The syngas, cleaned of particulate matter, is received at an HCl scrubber 226. The HCl scrubber 226 may consist of a low pressure venturi whose shell side may be constructed of mild steel and provided with a rubber and tile lining which may reduce corrosion by the acidic environment. In the HCl scrubber 226, the syngas is directed to a packed tower that includes a bottom holding area. The syngas may be cooled to approximately 75 degrees Celsius by the venturi. HCl is captured in a circulating low concentration stream. Due to the gas cooling and absorption of HCl gas, heat will be generated in the HCl scrubber 226. The heat may be removed with a graphite tube heat exchanger using cooling water on its shell side. At substantially the same time that the HCl gas is being scrubbed, a substantially continuous bleed stream may be removed and collected in an accumulation tank. Additional particulate matter may be removed from the HCl scrubber 226 through a side-stream filter press in communication with the HCl scrubber 226. Particulate removed through this filter may be periodically recycled back into the vessel 210.

If re-utilization of the HCl solution is not desired, an HCl bleed stream may be neutralized with an NaOH caustic solution to form a NaCl solution, which may then be recycled to the gas quencher and spray dryer system 218. Alternatively, the recovered HCl solution may be separated for removal from the system and reused. The cleaned syngas, free of HCl, may flow to an alkali scrubber 228 for recovery of a $Na_2S$ solution.

The alkali scrubbing system 228 may be a two stage packed bed scrubber. The bottom part of the scrubber may circulate a collected $Na_2S$ solution, about approximately 18 percent to approximately 20 percent, with about 1 percent to about 2 percent of free caustic solution 230, which would capture $H_2S$ gas from the syngas. The caustic solution 230 may then react with the $H_2S$ to form $Na_2S$ in an endothermic reaction (e.g., $H_2S+NaOH=Na_2S+H_2O$).

The upper part of the alkali scrubber may have a packed bed where the syngas comes in contact with a solution of $Na_2S$ and a higher concentration of free NaOH, such as about 5 percent to about 6 percent, to achieve an additional absorption of $H_2S$ that is not removed in the bottom section. Recovered $Na_2S$ may overflow from the holder at the bottom of the top section to a product collection tank. Cooling may be provided using an indirect heat exchanger on a circulating water circuit in order to further reduce moisture content of the syngas.

Depending on the incoming $H_2S$ loading, the $Na_2S$ by-product bleed stream could be removed from the bottom circulating stream of the alkali scrubber 228. This stream may be provided with a polishing filtration treatment to make it suitable for commercial use and/or sale. An overflow amount may also be received from the upper portion of the alkali scrubber 228. A make up caustic solution 230 may be added to the upper circulating stream of the alkali scrubber 228. Additionally, the alkali scrubber 228 may include a mist eliminator at the top of the scrubber to entrap any entrained liquid droplets.

Multiple induced draft fans (ID fans) may be provided in series downstream of the scrubbing system 224. In some systems 200, two ID fans 232 may be provided. The ID fans 232 may each be constructed of stainless steel 304 impeller and cased in mild steel rubber lined ("MSRL") or mild steel lined with fiberglass reinforced plastic ("MSFRP") to substantially resist corrosion due to the presence of wet gases. Placement of the ID fans 232 downstream assists in the creation of negative pressure within the vessel 210 and the rest of the waste treatment system 200. The ID fans 232 may also enable a fast response by a variable frequency drive during pressure variations that may occur in the vessel 210 during operation.

A syngas collection tank 234 may accumulate the cleaned syngas. The syngas collection tank 234 may have an approximate capacity of 5.5 $m^3$ and may accumulate the syngas at a pressure of about 1000 mmcg. In other smaller systems, the storage tank may have an approximate capacity of 1.5 $m^3$ and may accumulate the syngas at a pressure of about 1000 mmcg. From the syngas collection tank 234, the syngas may be processed by a syngas energy recovery system 236. In some systems 200, the syngas energy recovery system may vent exhaust gases back to a baghouse that is part of the carbon injection and mixing system 220. Prior to entering the baghouse, the received vent exhaust gases may pass through an electrostatic precipitator to filter out any particulate that may be entrained with the exhaust gases. Additionally, some systems 200, may use a booster fan to convey the syngas to the syngas energy recovery system 236.

Figure 3:
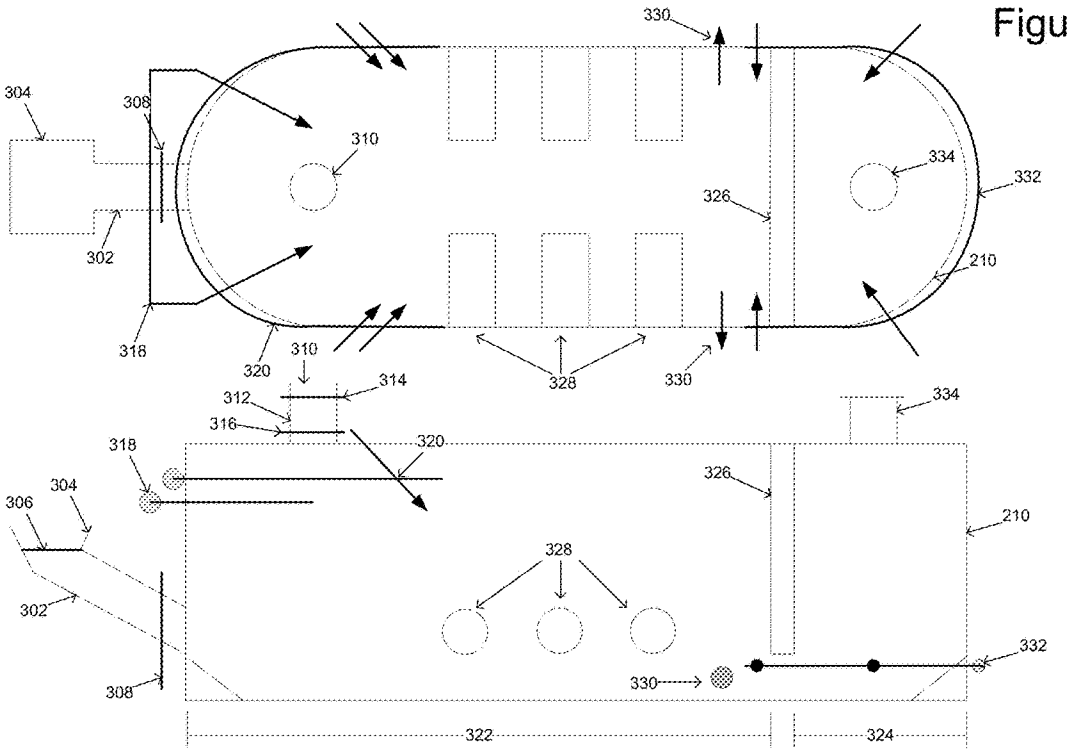
FIG. 3 is an illustration of a vessel that may be used to treat waste.

FIG. 3 is a top and side view illustration of the vessel 210 of the waste treatment system 200. The vessel 210 may be horizontally oriented, and may be generally oblong in shape. The vessel 210 may include a primary reaction chamber 322 and secondary reaction chamber 324. In some systems, the vessel 210 may have a volume of approximately 15.0 $m^3$. In these systems, the physical size of the vessel 210 may be such that the system will accommodate the charging of an individual batch of waste feedstock equal to about 12.5 kg of waste material during a charging cycle of approximately 30 seconds. The vessel 210 may be constructed of mild steel and the interior may be lined with layers of insulating materials. In some systems, the layers of insulating materials may include silicon carbide or graphite tiles, castable refractory, ceramic board, ceramic blanket, cerawool, and/or hysil block. The vessel 210 and insulating materials may be selected and designed to substantially minimize heat loses, to substantially ensure high levels of reliability in operations, including resistance to erosion and thermal shock, and to substantially optimize the time required for pre-heating the system and natural cool down. In some systems, the insulating material permits for an average life-span of approximately two years before entire replacement would be required. Nonetheless, as designed, the system provides easy access and flexibility to repair sections of damaged insulation material on a routine basis prior to the desired interval of about two years.

The primary reaction chamber 322 of the vessel 210 may permit a residence time of about 2.0 seconds based on a design basis gas flow of approximately 3,000 $Nm^3$/hr. The secondary reaction chamber 324 may be physically separated from the primary reaction chamber 322 by an internal baffle 326 that is open at the bottom. In some systems, this opening may be created when the baffle does not reach down to the bottom of the vessel 210. In some other systems, the opening may be formed by a void in the internal baffle 326. In some vessels 210, the baffle 326 may be a separate component that is mounted to the interior of the vessel 210. In other vessels 210, the baffle 326 may be a unitary part that is formed with the interior of the vessel 210. Syngas generated in the primary reaction chamber 322 may be forced downward in the vessel 210 and pass through the opening formed by or in the internal baffle 326 into the secondary reaction chamber 324. The downstream ID fans create a negative effect in the system, drawing the syngas generated in the primary reaction chamber 322 through the remainder of the vessel 210 and through the other intervening systems. The downward action on the syngas in the vessel 210 helps to enhance mixing within the primary reaction chamber 322, increase the effective residence time within the primary reaction chamber 322, and/or prevent the syngas from exiting the primary reaction chamber 322 too quickly.

The secondary reaction chamber 324 provides additional residence time for the syngas. In some systems, the additional residence time may be about 1.0 seconds. In the secondary reaction chamber 324, the syngas may be further conditioned with the addition of an oxidant, such as steam. The addition of the oxidant may provide additional temperature control and may reduce the amount of un-reacted carbon that may have been carried over in the syngas. The oxidant may also enrich the calorific value of the syngas through an increase in the amount of hydrogen gas produced.

A feeding chamber 302, included as part of the compressible feed system, is shown in FIG. 3 positioned at an incline with respect to the vessel 210. A feeding hopper 304 is positioned at the top of the compressible feeding chamber 302. A first isolation gate 306 separate the feeding hopper 304 from the top of the compressible feeding chamber 302. A second isolation gate 308 separate the compressible feeding chamber 302 from the vessel 210, and may be opened to charge the vessel 210 with solid, semi-solid, and in some conditions, liquid waste feedstock contained within the compressible feeding chamber 302. A mechanical or hydraulically operated screw feeder (not shown) may be positioned within the compressible feeding chamber 302, and may be used to shred, crush, or compress waste within the feeding chamber 302.

Waste that cannot be processed through the compressible feeding chamber 302 may be received in the vessel 210 through the non-compressible waste feed system. The non-compressible waste feed system may include a non-compressible feeding chamber 310. A feeding hopper 312 is positioned at the top of the non-compressible feeding chamber 310. A first non-compressible feed system isolation gate 314 is positioned below the feeding hopper 312 at the top of the non-compressible feeding chamber 310. A second non-compressible feed system isolation gate 316 separates the non-compressible feeding chamber 310 from the vessel 210, and may be opened to charge the vessel 210 with solid and/or semi-solid waste feedstock contained within the non-compressible feeding chamber 310.

Liquid waste may be fed to the vessel 210 through a liquid waste system. As shown in FIG. 3, the liquid waste system may include a feeding header and nozzles 318. Although two nozzles are depicted in FIG. 3, additional nozzles may be present. Liquid waste may be pumped from one or more storage tanks containing a single source of liquid waste, and/or from one or more mixing tanks containing liquid waste from multiple sources. The nozzles of the liquid waste system may be angled with respect to the horizontal and may be angled downward at a bias angle to direct the injected liquid waste into a specific portion of the vessel 210.

A primary reactor oxidant injection system 320 may be positioned with respect to a primary reactor chamber 322 of the vessel 210. As shown in FIG. 3, the primary reactor oxidant injection system 320 includes four nozzles, depicted as two pairs of angled parallel arrows. The number of nozzles and their placement and orientation are for exemplary purposes only. More or less nozzles may be used in a waste treatment system, and these nozzles may be placed at different locations with respect to the primary reactor chamber 322. The primary oxidant injection system 320 may include one or more injectors or nozzles that may be mounted at an elevation in proximity to the top of the opening for the compressible feeding chamber 302 that leads into the vessel 210. The injectors or nozzles of the primary reactor oxidant injection system 320 may be angled with respect to the horizontal and may be angled downward at a bias angle to direct the injected oxidant into the interior of the primary reactor chamber 322. Water may be used to cool the primary oxidant injection system 320 nozzles.

Positioned at or near the center of the vessel 210 are the torch electrodes 328. The torch electrodes may be mounted individually or collectively with an electrode holding assembly (not shown), such that the torch electrodes 328 are insulated from and elevated above a bottom of the vessel 210 where a slag pool may form as inorganic waste is melted or vitrified during the waste treatment process. The electrode holding assembly insulates the pairs of electrode elements forming the anode and cathode and helps to ensure that they are maintained within a predetermined temperature range. The anode and cathode of each pair of electrodes may be moved into and out of the vessel 210. Inching motors manufactured by Bonfiglioli may be used to control the movement of the electrodes.

Electrodes may be inserted into the vessel 210 from an exterior of the vessel 210. Once placed within the vessel 210, the electrodes may be positioned with respect to one another through the use of the electrode holding assembly. Over time, the electrodes will be consumed, by forming the arc that heats the vessel 210, and will require replacement. The electrodes may have a geometry to facilitate replacement. In some systems, the electrodes may be generally cylindrically shaped with an approximate diameter of about 250 mm. The electrodes may be manufactured in replaceable sections of approximately 450 mm to approximately 500 mm in length. The replaceable sections of the electrodes may be outfitted with a male thread connection at one end and a female threaded connection at the other end. Thus, as the electrodes are consumed, replacement sections may be attached to existing portions of the electrodes within the electrode holding assembly from the outside of the vessel 210. The replacement sections may be attached to the existing portions of the electrodes by connecting the appropriate threaded ends. In other systems, the electrodes may have other shape, such as generally square, generally hexagonal, generally octagonal, or other shapes. In such instances, one end of the replacement section of the electrode may include a smaller generally cylindrical shaped protrusion that includes threading, and an opposite end that may include a generally cylindrical void that includes receiving threads. Thus, replacement electrode sections may be mated together to form a replacement electrode that may be inserted into an utilized in the vessel 210.

The electrode holding apparatus may include sliding platforms that are positioned within the vessel 210. These sliding platforms support the electrodes and elevate them above a slag pool that may form in the bottom of the vessel 210 as waste is treated. Through the use of the sliding platforms and inching motor, the electrodes may be positioned within approximately 10 mm of each other for an arc to be struck. Once an arc is struck, the inching motor may be employed to separate the electrodes to a distance of approximately 25 mm to approximately 75 mm from one another. By controlling the gap between the electrodes, an arc-voltage between the electrodes may be controlled, which in turn can be used to regulate the internal temperature of the vessel 210. The larger the gap between the electrodes, the higher the operating voltage and the lower the operating current Slag that is generated in the vessel 210 from melted and/or vitrified inorganic waste may be extracted from the vessel 210 through slag tap ports 330. During non-tapping operations, the tap ports 330 are closed using water-cooled tap plugs. When tapping is to be initiated, a tap plug may be removed permitting the slag and/or vitrified mixture to flow out of a tap port 330. The removed slag and/or vitrified mixture may be collected with a collection system 214.

The syngas generated in the primary reactor chamber 322 may pass into the secondary reactor chamber 324. A secondary oxidant injection system 332 may be mounted with the secondary reaction chamber 324 towards the bottom of the vessel 210, but above a highest designed level of a slag pool. The secondary oxidant system 332 may include nozzles that are directed to the interior of the vessel 210 and that are positioned at an angle to the horizontal and at a bias angle directed towards the approximate center of the secondary reactor chamber 324. As shown in FIG. 3, the secondary reactor oxidant injection system 332 includes four nozzles, depicted as four arrows pointed inward into the vessel 210, two of which are shown to the right of the baffle 326 and two of which are to the left of the baffle 326. The number of nozzles and their placement and orientation are for exemplary purposes only, and the number and placement of these nozzles may vary depending on design considerations. At the top of the secondary reactor chamber 324 is a syngas outlet nozzle 334. The syngas leaving the vessel 210 may pass through the syngas outlet nozzle 334 to other downstream elements of the waste treatment system, such as a gas quencher and spray drying system 218.

Figure 4:
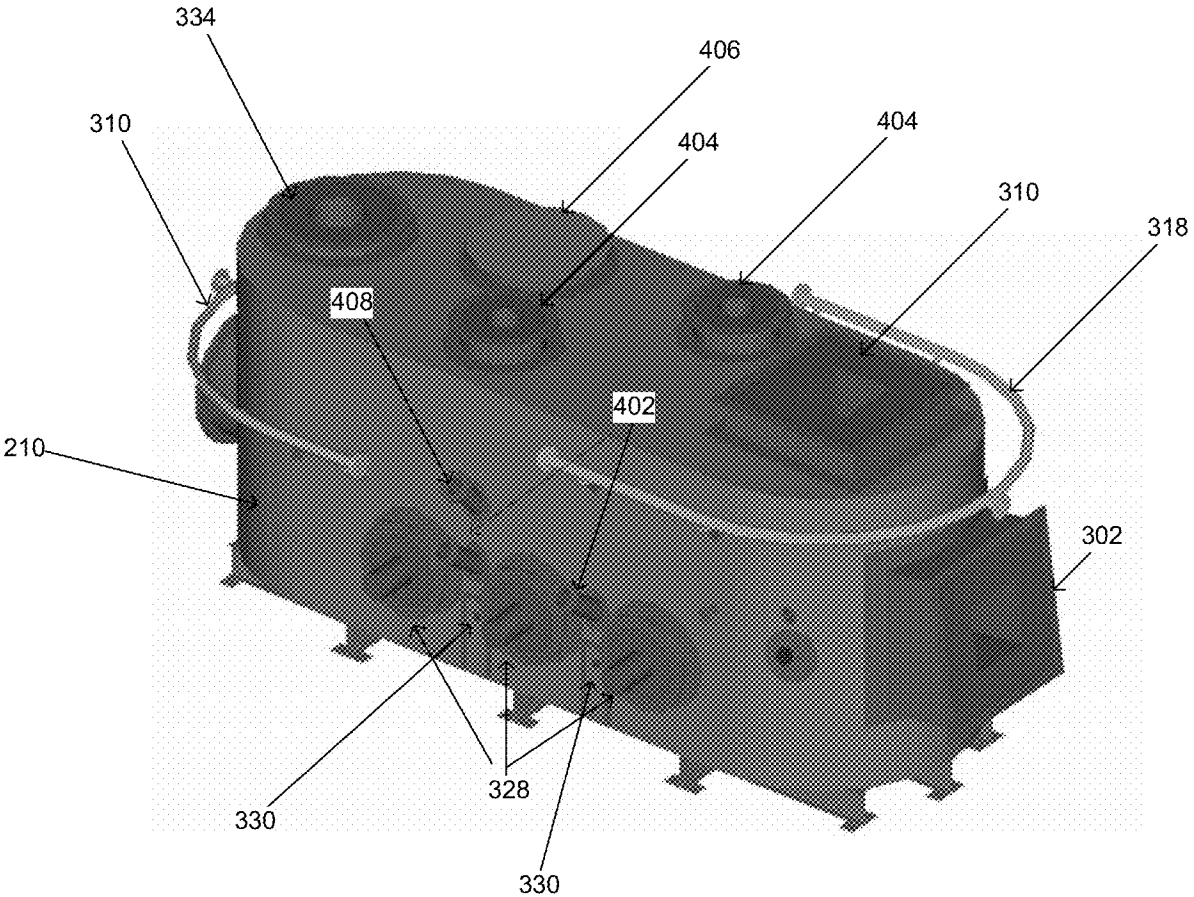
FIG. 4 is a second representation of a vessel that may be used to treat waste.

FIG. 4 is a second representation of a vessel that may be used with a waste treatment system of FIG. 2. In FIG. 4, some of the features and components of the vessel 210 as discussed with respect to FIG. 3 are shown and labeled. Additionally, in FIG. 4, tapping plasma torches 402 are shown. Tapping plasma torches 402 may extend through the refractory of the vessel 210, and may be positioned at an inclined angle with respect to the wall of the vessel 210. In some systems, the tapping plasma torches may be at an angle of about 5 degrees to about 30 degrees. The tapping plasma torches 402 may generate about 15 kilowatts each and may be directed towards the slag and/or vitrified mixture in the slag pool near that tap ports 330 to maintain the fluidity of the molten vitrified material and/or slag. The tapping plasma torches 402 may be operated by a computer controller.

The vessel 210 may also include one or more emergency vents 404 to vent out gas generated within the vessel 210 in an emergency or shut down condition. During installation or a shut down period, the interior of the vessel 210 may be accessed through manhole 406. The interior of the vessel 210 may require access to adjust, clean, or replace an internal component of the vessel 210. As shown in FIG. 4, a thermocouple port 408 is positioned about the electrodes 328 and one of the tapping ports 402. Although the placement of the thermocouple may vary with design, a thermocouple located near the electrodes may help the operator to ensure that the temperature within the vessel 210 is sufficient to melt the inorganic waste ad dissociate the organic waste into its elemental components.

Figure 5:
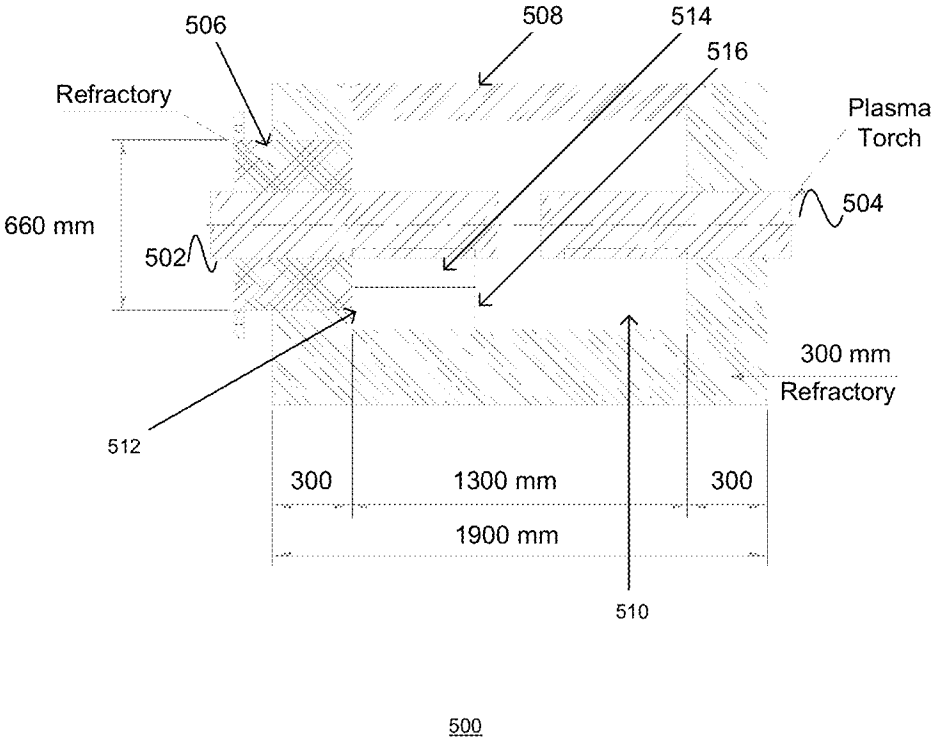
FIG. 5 is a partial sectional view of a vessel that may be used to treat waste.

FIG. 5 is a partial sectional front view of a primary reaction chamber of a vessel that may be used to treat waste in accordance with the waste treatment systems disclosed herein. In FIG. 5, a vessel 500 contains electrode elements 502 and 504 which represent a cathode and anode, respectively. As shown in FIG. 5, the vessel 500 made be constructed with refractory sides walls that are approximately 300 mm thick. A bottom of the vessel 500 may likewise be constructed of similar refractory material that is used for the side walls of the vessel 500. A flange 506 constructed of a separate refractory material may surround one of the electrodes (the cathode as shown in FIG. 5) at an insertion point into the vessel 500. This flange 506 may isolate the heat generated within the vessel 500 from the outside of the vessel 500. As shown in FIG. 5, the electrodes that are the cathode 502 and anode 504 are accessible from the outside of the vessel 500. An upper portion 508 of the vessel 500 may be constructed from a different type of refractory material than is used for the side walls and bottom of the vessel 500. Although not shown in FIG. 5, a flange 506 also surrounds a portion of the electrode on the other side of the vessel 500.

An anode sliding platform 510 that is part of the electrode holding assembly is shown in FIG. 5. As shown, the anode sliding platform supports the anode 504 and elevates it above the bottom of the vessel 500, where a slag may form from the melted inorganic material. The anode sliding platform 510 may be constructed of a similar material as the interior bottom of the vessel 500 to aid in a substantially even conduction of heat. Where the bottom of the vessel 500 is constructed of different layers of refractory materials, the anode sliding platform 510 may be constructed of a similar material as the top most (e.g., the layer that interacts with the melted inorganic waste) layer of refractory material. A cathode sliding platform 512, also part of the electrode holding assembly, may comprise multiple layers of materials to electrically isolate the cathode 502 from the bottom of the vessel 500. As shown in FIG. 5, the cathode sliding platform 512 comprises a top layer 514 and a bottom layer 516. The top layer 514 of the cathode sliding platform 512 may comprise a material with low electrical conductivity in order to electrically isolate the cathode 502 from the rest of the vessel 500. A lower layer 516 may comprise an insulating material to isolate top layer 514 from the interior bottom of the vessel 500. In some systems, the insulating material may be cerawool or synthania. The sliding platforms 510 and 512, may support the electrodes such that they are in-line with one another from opposing sides of the vessel 500. In some systems, the sliding platforms may include a groove or channel that aids in supporting the electrodes.

Although FIG. 5 shows the cathode 502 on the left of the sectional view of the vessel 500, and the anode 504 on the right of the sectional view of the vessel, the electrodes and their associated sliding plates could be arranged in the opposite configuration.

Figure 6:
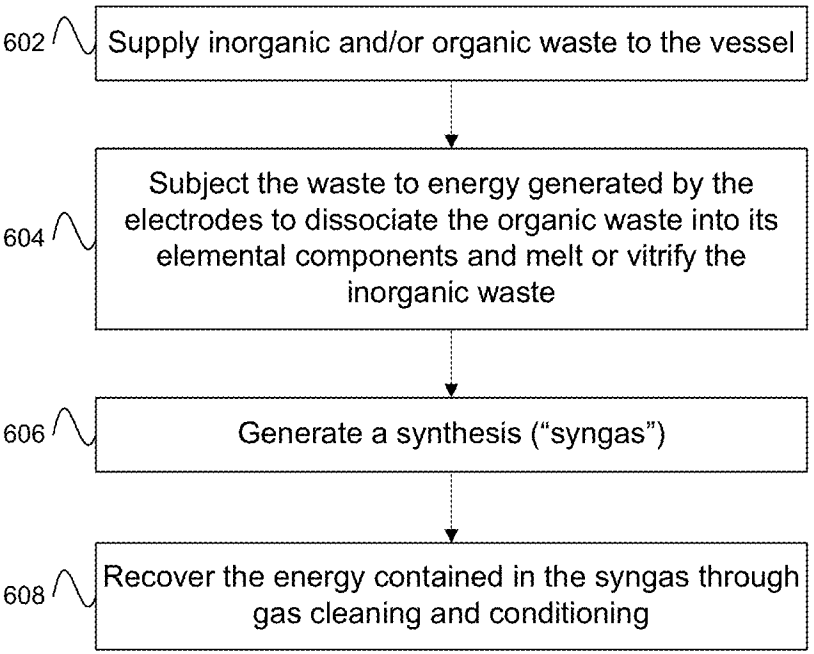
FIG. 6 is a flow chart of a method of processing waste with a waste treatment system.

FIG. 6 is a method of processing inorganic and organic waste with a waste treatment system. At act 602 inorganic and organic waste may be supplied to the vessel. The waste may be supplied through a solid and/or liquid waste feed system. In some systems, the liquid waste may be supplied through one or more atomizing nozzles positioned around the vessel. Solid waste may be supplied through one or more solid waste feed systems.

At act 604 the waste may be subjected to energy generated by an arc created between one or more pairs of electrodes that are positioned at the bottom of the vessel. When the waste is subjected to the energy in the vessel, the organic components may be gasified and substantially dissociate into elemental components. The elemental components of the organic waste may include solid carbon (carbon particulate), hydrogen gas, nitrogen, and in some instances halogens. The inorganic waste may be melted or vitrified forming a slag that is retained in the bottom of the vessel. The slag may be removed through a tapping process at periodic intervals.

The gasified organic waste elements may remain in the vessel for a predetermined resident time and form a syngas that includes carbon monoxide gas and hydrogen gas at act 606. The addition of an oxidant may assist the re-arrangement of the elemental components into the syngas. At act 608 the energy contained in the syngas may be conditioned, cleaned, and/or recovered through downstream processing.

Figure 7:
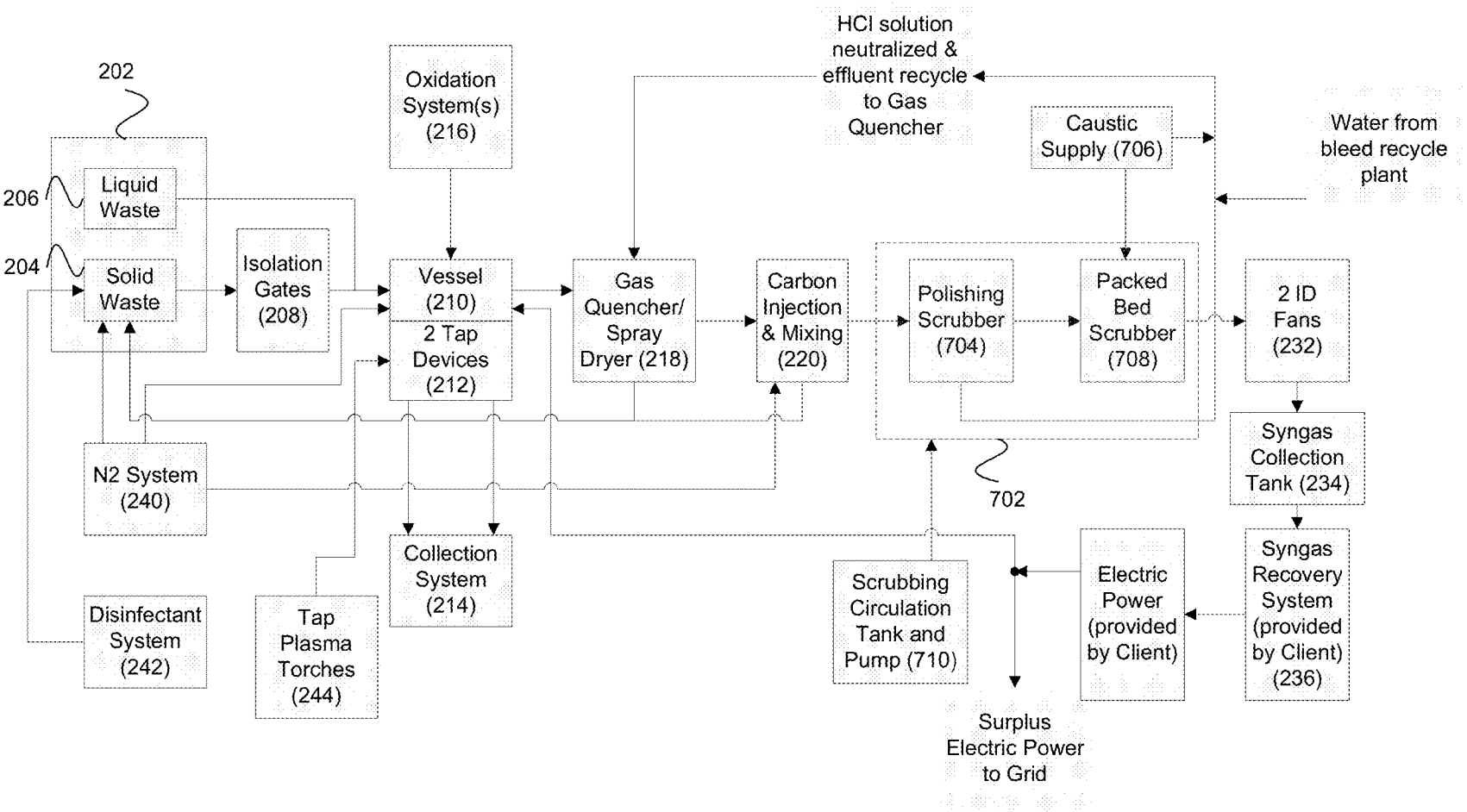
FIG. 7 is a second diagram of a waste treatment system.

FIG. 7 is a second diagram of a waste treatment system. The waste treatment system 700 of FIG. 7 does not recover HCl or $Na_2S$ solutions. In this configuration, the syngas flows from the carbon injection and mixing system 220 to a scrubbing system 702. A polishing scrubber 704 receives and treats the syngas to substantially remove acid gases through the addition of a caustic solution 706 to a circulating water stream. The scrubber system 702 may also include a counter-current flow packed bed scrubber 708 used to substantially remove entrained particulate matter carried over in the syngas, and to carry out a chemical absorption of acid gases $H_2S$ and HCl. In some systems 700, the scrubber system 702 circulation liquid may be substantially maintained at a pH of about 9 to about 10. The pH level may be substantially maintained through a substantially continuous dosing of a caustic solution through a caustic solution dosing pump from a caustic solution supply 706. At the top of the packed bed scrubber 708, packing may be provided which may act as a mist eliminator for gases, and which may entrap entrained liquid droplets from cleaned gases from the packed bed scrubber 708. A washing line may be provided for dry packing. In some systems 700, the washing line is operated at regular intervals.

A scrubber liquid circulation tank and a scrubber pump 710 may be provided for holding the scrubber circulating liquid and for circulating the scrubber liquid through the venturi and packed bed scrubbers 708. The circulating scrubber liquid may be cooled down to about 50 degrees Celsius in a shell and tube-type heat exchange by circulating cooling water on the shell side of the heat exchanger. The cooled scrubber liquid, when circulated in the packed bed scrubber 708, may cool down the gases to less than about 55 degrees Celsius. This cooling may result in the condensation of water vapor from the gas and may minimize water vapor being carried over with the syngas.

A side stream from the scrubber pump may be continuously circulated through a plate and a frame-type filter press at an appropriate rate to substantially continuously filter any captured particulate matter from the scrubber liquid in the system. The filtrate from the filter press may be brought back to the scrubber circulation tank. At periodic intervals, the filter press may be opened and sludge collected from a bottom trough. The collected sludge may be repacked and fed back into the vessel 210.

Figure 8A:
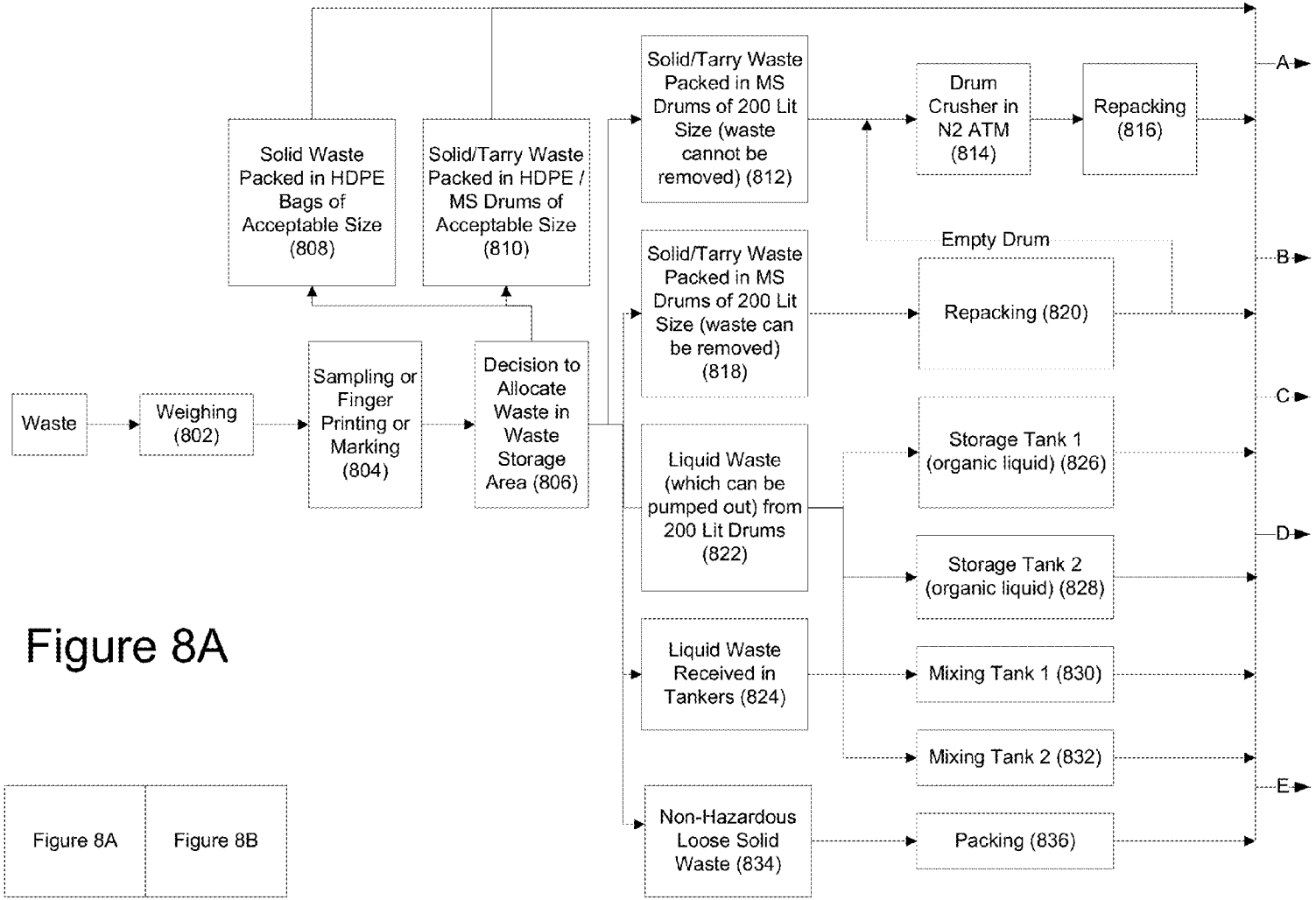
FIGS. 8A and 8B are a flow diagram for feeding waste to a waste treatment system.
Figure 8B:
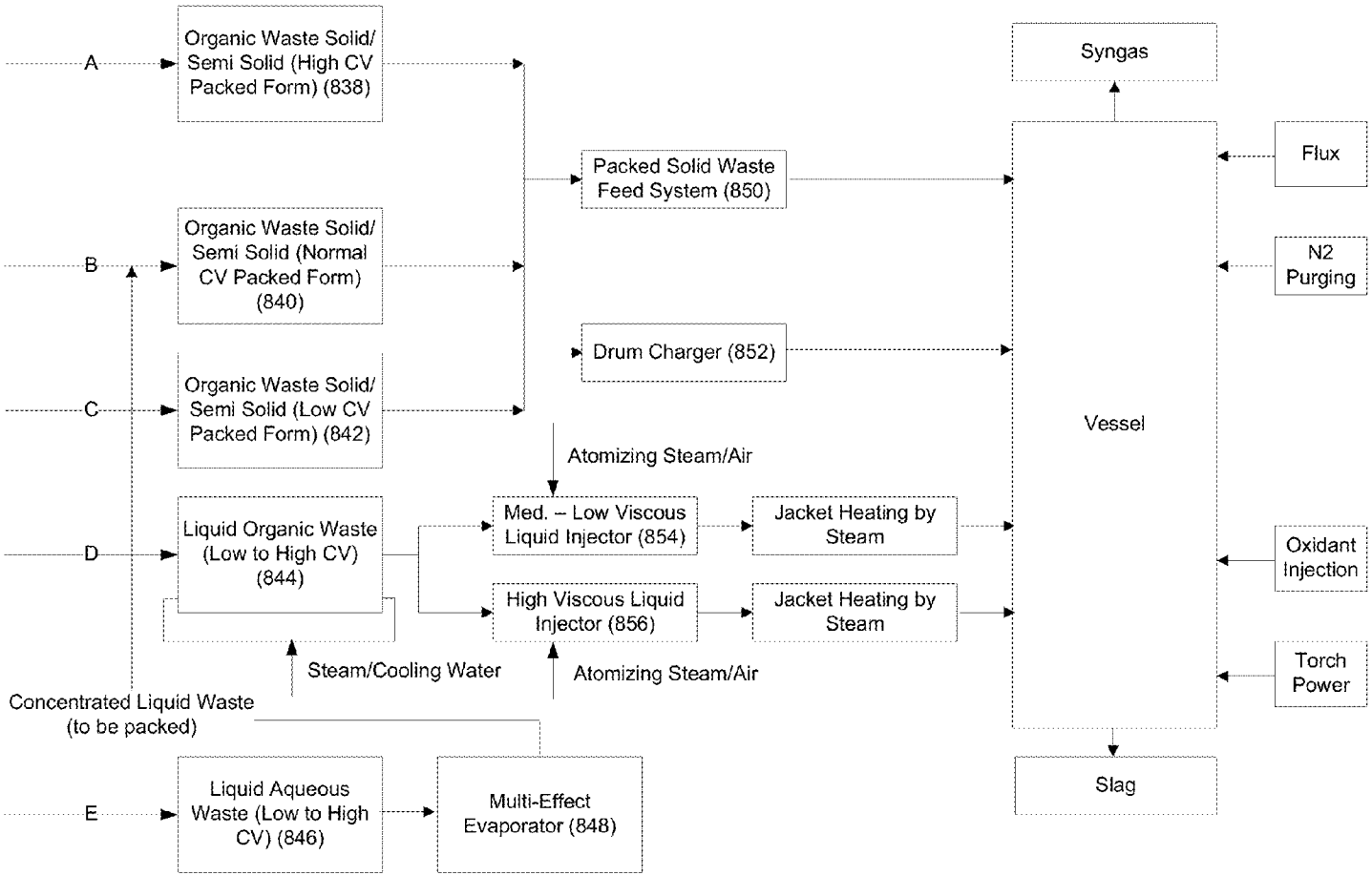

FIGS. 8A and 8B illustrate a flow process for feeding waste to a waste treatment system 102. A legend explaining how FIGS. 8A and 8B relate to one another is shown in the lower left hand corner of FIG. 8A. Additionally, the arrows identified with letters "A-E" are provide to assist with matching up FIGS. 8A and 8B, and do not otherwise relate to the flow process. At act 802 received waste is weighed. Weighing of the waste is beneficial to know whether the waste requires repacking further downstream. At act 804 the waste is sampled and marked. Identification of the waste may be determinative as to how the waste is processed. Some types of wastes do not mix well together. As such, they should not be processed in the waste treatment system at the same time. At act 806 a decision is made as to how the waste will be treated by the waste treatment system. In instances where wastes that should not be combined are present, one type of waste may be stored while the waste treatment system may process the other type of waste. In other instances, some of the received waste may require repacking while other waste does not require repacking. As such, a decision may be made as to which type of waste is to be processed first.

At act 808 solid waste received in high density polyethylene (HDPE) bags that are of sufficient size to be received through the feeding isolation gate of the compressible or non-compressible feeding system are processed without repacking. At act 810 solid and/or tarry waste received in HDPE or MS drums that may be received through the feeding isolation gate of the compressible or non-compressible feeding system are processed without repacking. In some systems, HDPE bags or drums of acceptable size may be fed into the vessel at a rate of about 1,500 kg/hr. In other smaller systems, HDPE bags or drums may be fed into the vessel at a rate of 350 kg/hr.

At act 812 drums of solid and/or tarry waste that cannot be removed from the drums are received. In act 812, the drums are MS drums of 200 liters, but other sized drums may be received where the waste cannot be removed. Pre-treatment of the drums with a separate system is required to process this waste. The pre-treatment system may be located off-site or else at the facility where the waste treatment system is located. One example of pre-treatment may include crushing the drum in a nitrogen rich environment with a crusher, such as at act 814. The crushed drum and waste may be repacked, at act 816, into bags or drums that may be adequately received by the waste treatment system.

In some instances, solid and/or tarry waste that can be removed from drums (or other packing) that are too large for processing by the waste treatment system are received (act 818). In these instances, the waste may be repacked at act 820 into adequately sized bags or drums. Empty drums may be crushed in a nitrogen rich environment drum with a crusher, and the crushed drum treated in the vessel 210.

Liquid waste may be received in different forms. In some instances, the liquid waste may be received in drums of 200 liters (act 822) and in other instances the liquid waste may be received in tankers (act 824). The liquid waste may be received from one source or from multiple different sources. In instances where the liquid waste is received from different sources, the manner of treatment may depend on whether the different types of liquid waste may be combined together. The received liquid waste may be transferred to different types of containers that may be part of the solvent waste feed system of the waste treatment system. As shown in FIG. 8A, organic liquid waste may be transferred to a storage tank at act 826, liquid waste dissolved in water may be transferred to a storage tank at act 828, and/or liquid waste may be transferred to one or more storage tanks in which different types of liquid wastes may be mixed at acts 830 and/or 832.

Non-hazardous waste may also be received in loose form at act 834. Loose waste may be package together at act 836 into bags and/or drums that may be received by the solid waste feed of the waste treatment system.

Received waste may be separated into different types of groups for processing by the waste treatment system. In FIG. 8B, possible groupings of organic solid and/or semi-solid packed waste may be based on the quantity of heat produced by the waste when it is processed in the vessel 210. In FIG. 8B, high calorific value wastes may be grouped together at act 838, normal calorific value wastes may be grouped together at act 840, and/or low calorific value wastes may be grouped together at act 842. Classification of calorific value wastes may vary, but in some instances, materials with a calorific value above about 6000 kcal/kg may be considered high calorific value wastes, materials with a calorific value below about 2000 kcal/kg may be considered low calorific value wastes, and materials with a calorific value between about 2000 and about 6000 kcal/kg may be considered normal calorific wastes. Liquid waste may also be grouped depending upon its type and/or calorific value. At act 844, liquid organic waste having a normal to a high calorific value may be group together.

Aqueous liquid waste having a low to normal calorific value may be grouped together at act 846, and may be processed by a multi-effect evaporator at act 848. The multi-effect evaporator may be used to concentrate the liquid waste which may then also be added to the packed waste grouped at act 840. In the multi-effect evaporator, multiple staged tanks may process the aqueous liquid waste by boiling it at different pressures. The vapor boiled off in each preceding staged tank may be used to heat the next staged tank. A first staged tank, however, requires an external heating source. The number of stages may vary based upon design, but a three stage multi-effect evaporator could be used to accomplish the recovery of the concentrated liquid waste at act 848.

The solid and/or semi-solid waste may be fed to the vessel through either the compressible (act 850) or non-compressible (act 852) waste feed systems. Medium to low viscous liquid waste may be fed to the vessel at act 854, while high viscous liquid waste may be fed to the vessel at act 856.

The vessel may receive the solid, semi-solid, slurry, tarry, and/or liquid wastes. The vessel may also receive nitrogen from a purging system, oxidant, torch power, and flux. The vessel may generate slag and syngas. Although the acts depicted in FIG. 8 are shown as separate acts, various acts may be performed in parallel while other acts are performed in series.

The capacity of waste treatment systems may vary. However, in some systems, the capacity of the solid waste feed system may be approximately 1,500 kg/hr for a compressible solid waste feed system and approximately 2,000 kg/hr for a non-compressible solid waste feed system. These capacities permit for the charging of additional feedstock generated by plant operations, including the addition of by-products generated by downstream components of the waste treatment system. In some systems, the composition of waste that may be processed by the waste treatment system may include the following non-limiting examples:

| | | Combined Waste | Packed Solid Waste (Drums) Type 1 | Loose Solid Waste (Bags) Type 2 | Liquid Waste High CV Type 3 | Liquid Waste Low CV after MEE Type 4A |
|---|---|---|---|---|---|---|
| Waste Composition | | | | | | |
| % Distribution | | 100 | 16.95394179 | 50.86182537 | 8.476970896 | 8.476970896 |
| Quantity in kg/hr | | 1608.636364 | 272.7272727 | 818.1818182 | 136.3636364 | 136.3636364 |
| Quantity in TPD | | 35.39 | 6 | 18 | 3 | 3 |
| Composition in Weight % Basis | | | | | | |
| Carbon | C | 44.82 | 42 | 47 | 66 | 20 |
| Hydrogen | H | 2.71 | 2 | 3 | 6 | 0 |
| Oxygen | O | 21.53 | 24 | 26 | 18 | 10 |
| Nitrogen | N | 1.10 | 1 | 1 | 1 | 3 |
| Chloride | Cl | 1.86 | 2 | 2 | 2 | 2 |
| Sulfur | S | 1.86 | 2 | 2 | 2 | 2 |
| Moisture | $H_2O$ | 13.50 | 15 | 14 | 3 | 35 |
| Inorganic/Inert | | 12.61 | 12 | 5 | 2 | 28 |
| Total | | 100.00 | 100.00 | 100.00 | 100.00 | 100.00 |
| Gross Calorific Value | | 3576.70 | 3094.00 | 3756.45 | 6670.05 | 1230.25 |

-continued

| | | | | | | |
|---|---|---|---|---|---|---|
| Net Calorific Value | | 3499.51 | 3007.00 | 3675.25 | 6652.65 | 1027.25 |
| | | Slurry and Sludge Type 5 | Flux | Gas Quencher Salts | Bag Filter Collection and Spent Carbon | Filter Press Sludge |
| Waste Composition (Weight % Basis) | | | | | | |
| % Distribution | | 8.4769709 | 1.97795988 | 3.41904493 | 1.27154563 | 0.06476971 |
| Quantity in kg/hr | | 136.363636 | 31.8181818 | 55 | 20.4545455 | 1.36363636 |
| Quantity in TPD | | 3 | 0.7 | 1.21 | 0.45 | 0.03 |
| Composition in Weight % Basis | | | | | | |
| Carbon | C | 63 | 0 | 0 | 90 | 20 |
| Hydrogen | H | 4 | 0 | 0 | 0 | 0 |
| Oxygen | O | 22 | 0 | 0 | 0 | 0 |
| Nitrogen | N | 1 | 0 | 0 | 0 | 0 |
| Chloride | Cl | 2 | 0 | 0 | 0 | 0 |
| Sulfur | S | 2 | 0 | 0 | 0 | 0 |
| Moisture | $H_2O$ | 5 | 0 | 0 | 10 | 70 |
| Inorganic/Inert | | 1 | 100 | 100 | 0 | 10 |
| Total | | 100.00 | 100.00 | 100.00 | 100.00 | 100.00 |
| Gross Calorific Value | | 5566.15 | 0.00 | 0.00 | 7272.00 | 1616.00 |
| Net Calorific Value | | 5537.15 | 0.00 | 0.00 | 7272.00 | 1616.00 |

Figure 9:
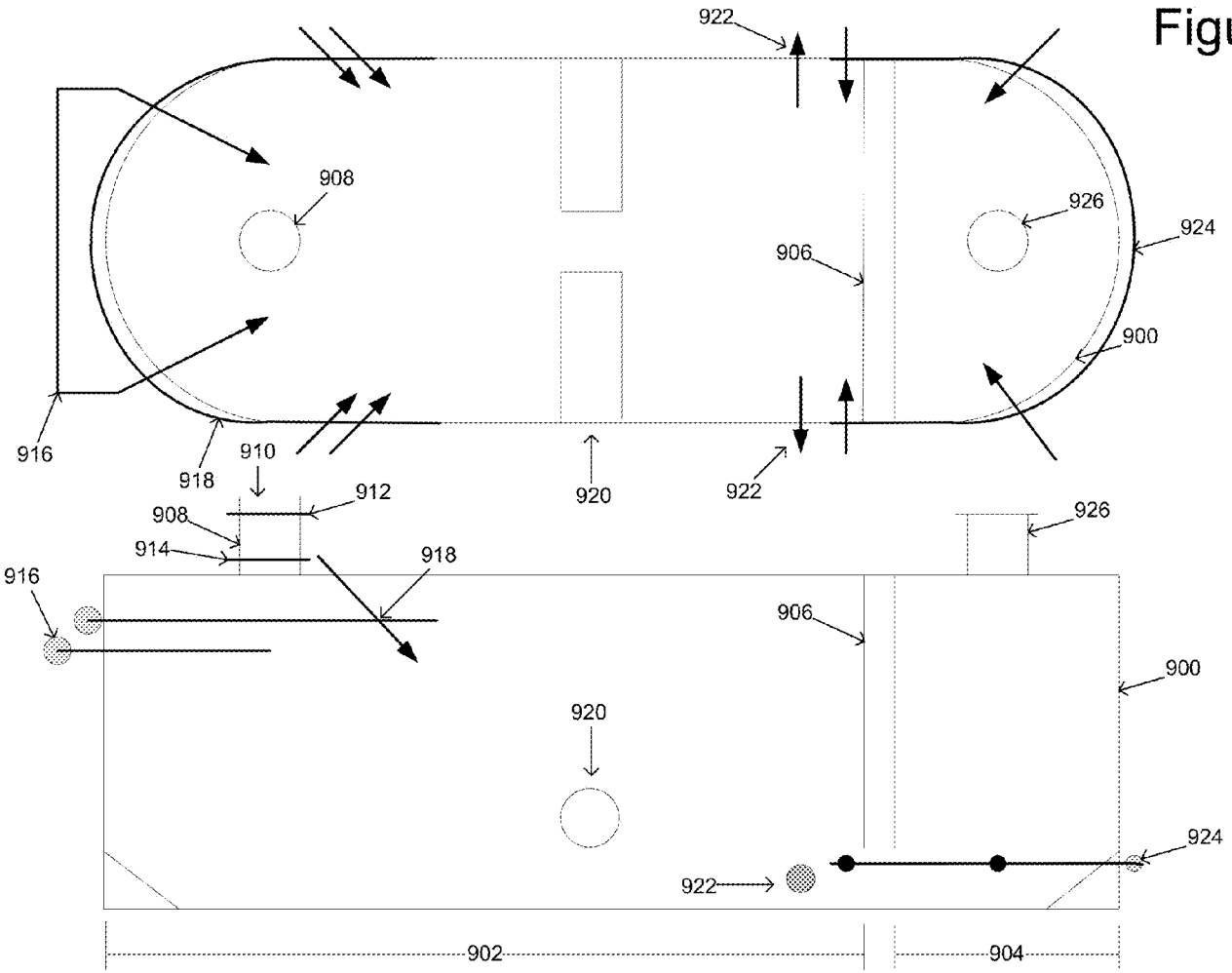
FIG. 9 is second illustration of a vessel that may be used for treating waste.

FIG. 9 is a top and side view of a second vessel that may be used to treat waste treatment system. The vessel 900 represents a vessel design that may be used with smaller waste processing systems, such as those described with respect to FIGS. 2 and 7, as well as the system described in FIG. 11. When the vessel 900 is used with the systems described in FIGS. 2 and 7, a solid waste feed system may not include a compressible waste feed system.

The vessel 900 may be horizontally oriented, and may be generally oblong in shape. The vessel 900 may include a primary reaction chamber 902 and secondary reaction chamber 904. In some systems, the vessel 900 may have a volume of approximately 4.0 $m^3$. In these systems, the physical size of the vessel 900 may be such that the system will accommodate the charging of an individual batch of waste feedstock equal to about 3.0 kg of waste material during a charging cycle of approximately 30 seconds. The vessel 210 may be constructed of mild steel and the interior may be lined with layers of insulating materials. In some systems, the layers of insulating materials may include silicon carbide or graphite tiles, castable refractory, ceramic board, ceramic blanket, cerawool, and/or hysil block. The vessel 900 and insulating materials may be selected and designed to substantially minimize heat loses, to substantially ensure high levels of reliability in operations, including resistance to erosion and thermal shock, and to substantially optimize the time required for pre-heating the system and natural cool down. In some systems, the insulating material permits for an average life-span of approximately two years before entire replacement would be required. Nonetheless, as designed, the system provides easy access and flexibility to repair sections of damaged insulation material on a routine basis prior to the desired interval of about two years.

The primary reaction chamber 902 of the vessel 900 may permit a residence time of about 2.0 seconds based on a design basis gas flow of approximately 850 $Nm^3$/hr. The secondary reaction chamber 904 may be physically separated from the primary reaction chamber 902 by an internal baffle 906 that is open at the bottom. In some systems, this opening may be created when the baffle does not reach down to the bottom of the vessel 900. In some other systems, the opening may be formed by a void in the internal baffle 906. In some vessels 900, the baffle 906 may be a separate component that is mounted to the interior of the vessel 906. In other vessels 900, the baffle 906 may be a unitary part that is formed with the interior of the vessel 900. Syngas generated in the primary reaction chamber 902 may be forced downward in the vessel 900 and pass through the opening formed by or in the internal baffle 906 into the secondary reaction chamber 904. Downstream ID fans may create negative pressure in the system, drawing the syngas generated in the primary reaction chamber 902 through the remainder of the vessel 900 and through the other intervening systems. The downward action on the syngas in the vessel 900 helps to enhance mixing within the primary reaction chamber 902, increase the effective residence time within the primary reaction chamber 902, and/or prevent the syngas from exiting the primary reaction chamber 902 too quickly.

The secondary reaction chamber 904 provides additional residence time for the syngas. In some systems, the additional residence time may be about 1.0 seconds. In the secondary reaction chamber 904, the syngas may be further conditioned with the addition of an oxidant, such as steam. The addition of the oxidant may provide additional temperature control and may reduce the amount of un-reacted carbon that may have been carried over in the syngas. The oxidant may also enrich the calorific value of the syngas through an increase in the amount of hydrogen gas produced.

A non-compressible gravity waste feed system may feed solid, semi-solid, and certain liquids into the vessel 900. The non-compressible gravity waste feed system may include a non-compressible gravity feeding chamber 908. A feeding hopper 910 is positioned at the top of the non-compressible gravity feeding chamber 908. A first non-compressible gravity feed system isolation gate 912 is positioned below the feeding hopper 910 at the top of the non-compressible gravity feeding chamber 908. A second non-compressible gravity feed system isolation gate 914 separates the non-compressible feeding chamber 908 from the vessel 900, and may be opened to charge the vessel 900 with solid and/or semi-solid waste feedstock contained within the non-compressible gravity feeding chamber 908

Liquid waste may be fed to the vessel 900 through a liquid waste system. As shown in FIG. 9, the liquid waste system may include a feeding header and nozzles 916. Although two nozzles are depicted in FIG. 9, additional nozzles may be present. Liquid waste may be pumped from one or more storage tanks containing a single source of liquid waste, and/or from one or more mixing tanks containing liquid waste from multiple sources. The nozzles of the liquid waste system may be angled with respect to the horizontal and may be angled downward at a bias angle to direct the injected liquid waste into a specific portion of the vessel 900.

A primary reactor oxidant injection system 918 may be positioned with respect to a primary reactor chamber 902 of the vessel 900. As shown in FIG. 9, the primary reactor oxidant injection system 918 includes four nozzles, depicted as two pairs of angled parallel arrows. The number of nozzles and their placement and orientation are for exemplary purposes only. More or less nozzles may be used in a waste treatment system, and these nozzles may be placed at different locations with respect to the primary reactor chamber 902. The injectors or nozzles of the primary reactor oxidant injection system 918 may be angled with respect to the horizontal and may be angled downward at a bias angle to direct the injected oxidant into the interior of the primary reactor chamber 902. Water may be used to cool the primary oxidant injection system 918 nozzles.

Positioned at or near the center of the vessel 900 is a torch electrode 920 comprising a graphite anode and a graphite cathode. The torch electrode 920 may be mounted with an electrode holding assembly (not shown), such that the torch electrode 920 is insulated from and elevated above a bottom of the vessel 900 where a slag pool may form as inorganic waste is melted or vitrified during the waste treatment process. The electrode holding assembly insulates the electrode elements forming the anode and cathode and helps to ensure that they are maintained within a predetermined temperature range. The anode and cathode may be moved into and out of the vessel 900. Inching motors manufactured by Bonfiglioli may be used to control the movement of the electrodes. The torch electrode 920 may produce approximately 400 kilowatts of energy, and may be controlled by an insulated gate bipolar transistor power supply (IGBT).

Electrodes may be inserted into the vessel 900 from an exterior of the vessel 900. Once placed within the vessel 900, the electrodes may be positioned with respect to one another through the use of the electrode holding assembly. Over time, the anode and cathode will be consumed, by forming the arc that heats the vessel 900, and will require replacement. The anode and cathode are formed from graphite and may have a geometry to facilitate replacement. In some systems, the anode and cathode may be generally cylindrically shaped with an approximate diameter of about 250 mm. The electrodes may be manufactured in replaceable sections of approximately 450 mm to approximately 500 mm in length. The replaceable sections of the electrodes may be outfitted with a male thread connection at one end and a female threaded connection at the other end. Thus, as the anode and cathode are consumed, replacement sections may be attached to existing portions within the electrode holding assembly from the outside of the vessel 900. The replacement sections may be attached to the existing portions of the anode or cathode by connecting the appropriate threaded ends. In other systems, the electrodes may have other shapes, such as generally square, generally hexagonal, generally octagonal, or other shapes. In such instances, one end of the replacement section of electrode may include a smaller generally cylindrical shaped protrusion that includes threadings, and an opposite end may include a generally cylindrical shaped void that includes receiving threads. Thus, replacement electrode sections may be mated together to form a replacement electrode that may be inserted utilized in the vessel 900.

The electrode holding apparatus may include sliding platforms that are positioned within the vessel 900. These sliding platforms support the electrodes and elevate them above a slag pool that may form in the bottom of the vessel 900 as waste is treated. Through the use of the sliding platforms and inching motor, the anode and cathode may be positioned within approximately 10 mm of each other for an arc to be struck. Once an arc is struck, the inching motor may be employed to separate the anode and the cathode to a distance of approximately 25 mm to approximately 75 mm from one another. By controlling the gap between the electrodes, an arc-voltage between the anode and cathode may be controlled, which in turn can be used to regulate the internal temperature of the vessel 900. The larger the gap may be between the electrodes, the higher the operating voltage and the lower the operating current Slag that is generated in the vessel 900 from melted and/or vitrified inorganic waste may be extracted from the vessel 900 through slag tap ports 922. During non-tapping operations, the tap ports 922 are closed using water-cooled tap plugs. When tapping is to be initiated, a tap plug may be removed permitting the slag and/or vitrified mixture to flow out of a tap port 922. The removed slag and/or vitrified mixture may be collected with a collection system 214. Plasma torches may be mounted to the vessel 900 and directed towards the area of the slag pool near the tap port 922 to increase the fluidity of the slag.

The syngas generated in the primary reactor chamber 902 may pass into the secondary reactor chamber 904. A secondary oxidant injection system 924 may be mounted with the secondary reaction chamber 904 towards the bottom of the vessel 904, but above a highest designed level of a slag pool. The secondary oxidant system 924 may include nozzles that are directed to the interior of the vessel 900 and that are positioned at an angle to the horizontal and at a bias angle directed towards the approximate center of the secondary reactor chamber 904. As shown in FIG. 9, the secondary reactor oxidant injection system 924 includes four nozzles, depicted as four arrows pointed inward into the vessel 900, two of which are shown to the right of the baffle 906 and two of which are to the left of the baffle 906. The number of nozzles and their placement and orientation are for exemplary purposes only, and the number and placement of these nozzles may vary depending on design considerations. At the top of the secondary reactor chamber 906 is a syngas outlet nozzle 926. The syngas leaving the vessel 900 may pass through the syngas outlet nozzle 926 to other downstream elements of the waste treatment system, such as a gas quencher and spray drying system.

Figure 10B:
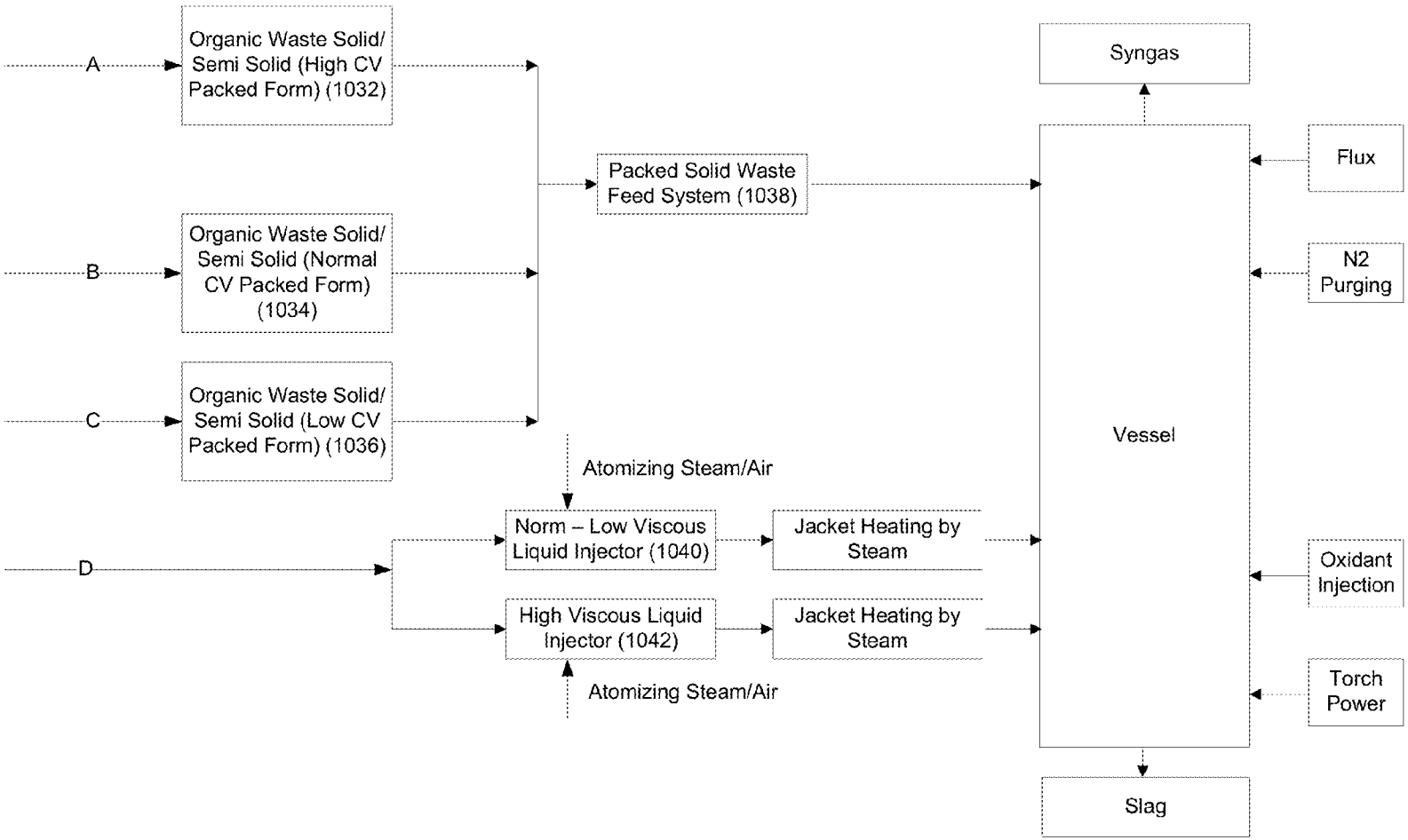

FIGS. 10A and 10B illustrate a flow process for feeding waste to a vessel 900. A legend explaining how FIGS. 10A and 10B relate to one another is shown in the lower left hand corner of FIG. 10A. Additionally, the arrows identified with letters "A-D" are provide to assist with matching up FIGS. 10A and 10B, and do not otherwise relate to the flow process. At act 1002 received waste is weighed. Weighing of the waste is beneficial to know whether the waste requires repacking further downstream. At act 1004 the waste is sampled and marked. Identification of the waste may be determinative as to how the waste is processed. Some types of wastes do not mix well together. As such, they should not be processed in vessel 900 or by the waste treatment system at the same time. At act 1006 a decision is made as to how the waste will be treated by the waste treatment system. In instances where wastes that should not be combined are present, one type, of waste may be stored while the waste treatment system may process the other type of waste. In other instances, some of the received waste may require repacking while other waste does not require repacking. As such, a decision may be made as to which type of waste is to be processed first.

At act 1008 solid waste received in high density polyethylene (HDPE) bags that are of sufficient size to be received through the feeding isolation gate of the non-compressible feeding system are processed without repacking. At act 1010 solid and/or tarry waste received in HDPE or MS drums that may be received through the feeding isolation gate of the non-compressible feeding system are processed without repacking. In some systems, HDPE bags or drums of acceptable size may be fed into the vessel at a rate of about 350 kg/hr.

At act 1012 drums of solid and/or tarry waste that where the waste cannot be removed from the drums are received. In act 1012, the drums are MS drums of 200 liters, but other sized drums may be received where the waste cannot be removed. Pre-treatment of the drums with a separate system is required to process this waste. The pre-treatment system may be located off-site or else at the facility where the waste treatment system is located. One example of pre-treatment may include crushing the drum in a nitrogen rich environment with a crusher, such as at act 1014. The crushed drum and waste may be repacked, at act 1016, into bags or drums that may be adequately received by vessel 900.

In some instances, solid and/or tarry waste that can be removed from drums (or other packing) that are too large for processing by the waste treatment system are received (act 1018). In these instances, the waste may be repacked at act 1020 into adequately sized bags or drums. Empty drums may be crushed in a nitrogen rich environment drum with a crusher, and the crushed drum treated in the vessel 900.

Liquid waste may be received in different forms. In some instances, the liquid waste may be received in drums of 200 liters (act 1022). The liquid waste may be received from one source or from multiple different sources. In instances where the liquid waste is received from different sources, the manner of treatment may depend on whether the different types of liquid waste may be combined together. The received liquid waste may be transferred to different types of containers that may be part of the solvent waste feed system of the waste treatment system. As shown in FIG. 10A, liquid waste may be transferred to one or more storage tanks at acts 1026 and 1028. The storage tank that receives the liquid waste may depend upon the type of liquid waste.

Non-hazardous waste may also be received in loose form at act 1024. Loose waste may be package together at act 1030 into bags and/or drums that may be received by the solid waste feed of the waste treatment system.

Received waste may be separated into different types of groups for processing by the waste treatment system. In FIG. 10B, possible groupings of organic solid and/or semi-solid packed waste may be based on the quantity of heat produced by the waste when it is processed in the vessel 210. In FIG. 10B, high calorific value wastes may be grouped together at act 1032, normal calorific value wastes may be grouped together at act 1034, and/or low calorific value wastes may be grouped together at act 1036. Classification of calorific value wastes may vary, but in some instances, materials with a calorific value above about 6000 kcal/kg may be considered high calorific value wastes, materials with a calorific value below about 2000 kcal/kg may be considered low calorific value wastes, and materials with a calorific value between about 2000 and about 6000 kcal/kg may be considered normal calorific wastes.

The solid and/or semi-solid waste may be fed to the vessel through either the non-compressible (act 1038) waste feed systems. Medium to low viscous liquid waste may be fed to the vessel at act 1040, while high viscous liquid waste may be fed to the vessel at act 1042.

Figure 11:
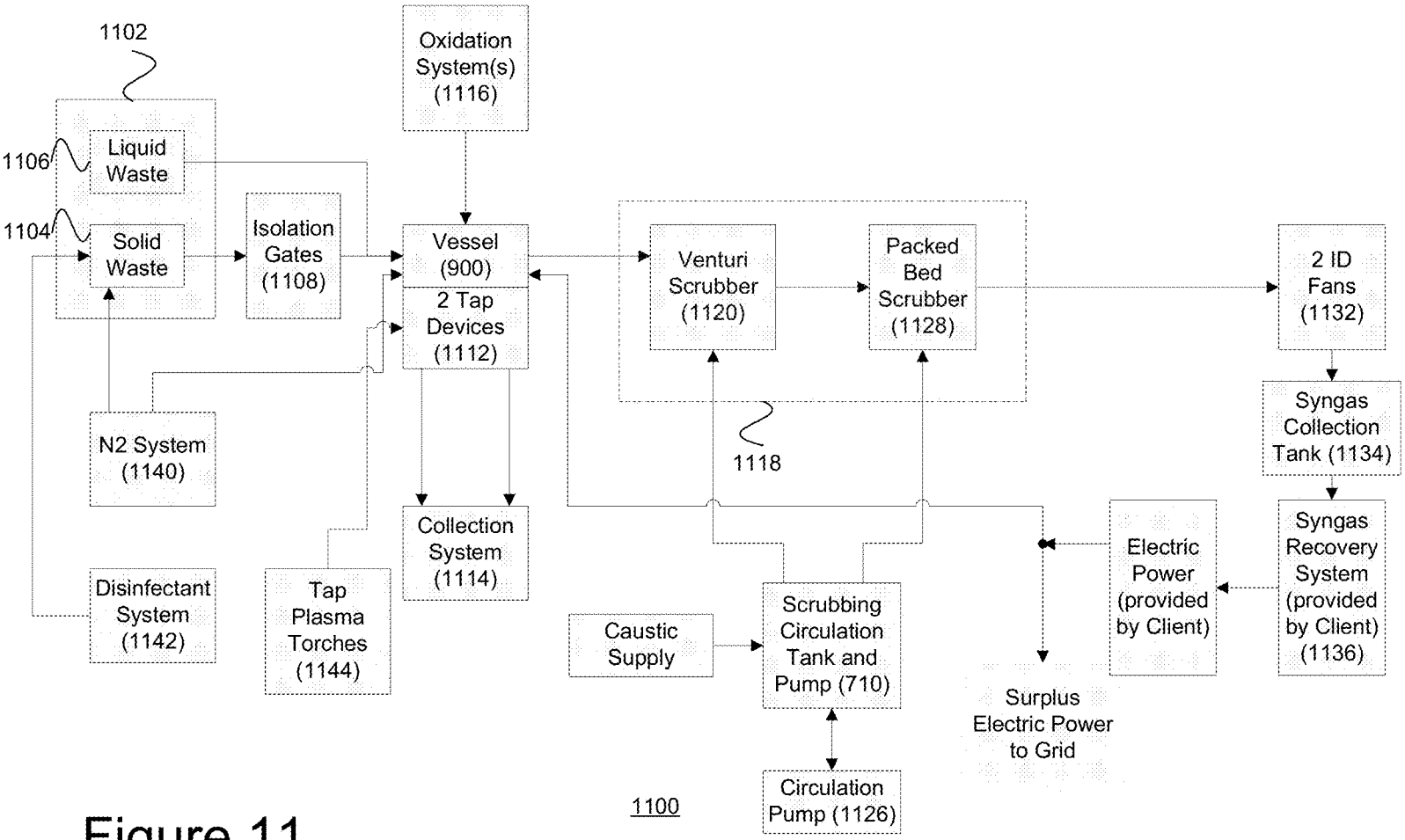
FIG. 11 is a third diagram of a waste treatment system.

FIG. 11 is a diagram of a waste treatment system 1100 that may be used with vessel 900. The vessel 900 may be coupled to a waste feed system 1102. The waste feed system 1102 may include a solid waste feed system 1104 and/or a liquid waste feed system 1106. The solid waste feed system 1104 may include a non-compressible feed system. The non-compressible feed system may be a gravity feed system. The gravity feed system may include a feeding chamber or tube that leads to the vessel 900 and may be used with wastes that cannot be shredded, crushed, or compressed. Additionally, the non-compressible feed systems may be used to feed powder wastes to the vessel 900.

The solid waste feed system 1104 is separated from the vessel 900 by an isolation gate system 1108. The isolation gate system 1108 may include two retractable isolation gates. A first isolation gate may be positioned proximate to a feeding hopper to permit feeding of waste feedstock into a feeding chamber of the solid waste feed system 1104. A second isolation gate may be positioned proximate to the vessel 900 and may permit the feeding of the waste feedstock into the vessel 900. The solid waste feed system 1104 may be controlled by a waste treatment system computer, such that only one isolation gate is open at a time. In some systems, a sensor may monitor the quantity of feedstock being introduced into the solid waste feed system 1104. After the first isolation gate closes, nitrogen may be introduced into the feeding chamber through one or more openings and/or nozzles. The nitrogen may be used to pressurize the feeding chamber to substantially reduce and/or prevent air from entering the vessel 900 with the waste feedstock, and to substantially prevent the potential for back-flow of combustible synthesis gas (e.g., "syngas") from the vessel 900. In some systems, a nitrogen system 1140 may supply nitrogen to the solid waste feed system 1104, the vessel 900, and/or other downstream components. The nitrogen may be supplied as a nitrogen "dump" into the feeding chamber whenever there is an emergency shut-down of the system as a safety feature to prevent back-flow of combustible gases. Alternatively, the nitrogen "dump" may be introduced directly into the vessel 900. In some systems 1100, the nitrogen system may have a capacity of about 25 $Nm^3$/hr to about 50 $Nm^3$/hr.

To help minimize and/or prevent the generation and/or release of toxic or hazardous materials from the solid waste feeding chamber when waste is received, a disinfectant system 1142 may introduce a disinfectant solution into the solid waste feed feeding chamber through an opening. In some systems, the opening may be the hopper that receives waste prior to entry into the feeding chamber. The received disinfectant may disinfect the feeding chamber and any excess solution may be drained into the vessel 900 and be processed as waste. In other systems, the disinfectant may be introduced through one or more nozzles positioned along a path of the solid waste feed feeding chamber.

The waste treatment system 1100 is versatile in that it may process various types of waste. In some instances, the solid waste feed system 1104 may be used to charge the vessel 900 with waste feedstock such as municipal solid waste, polychlorinated biphenyls ("PCB") contaminated materials, refinery waste, office waste, cafeteria waste, facilities maintenance waste (e.g., wooden pallets, oil, grease, discarded light fixtures, yard waste, wastewater sludge), pharmaceutical waste, medical waste, fly and bottom ash, industrial and laboratory solvents, organic and inorganic chemicals, pesticides, organo-chlorides, thermal batteries, post-consumer batteries, and military waste, including weapon components. Depending on the design of the system, the solid waste feed system 1104, may have approximately 600 mm clearance between each of its isolation gates. With this configuration, the solid waste system 204 may process waste that is about 400 mm in length. Waste exceeding this length may be preprocessed on or off-site prior to it being processed by the waste treatment system. In other systems, the amount of clearance and length of waste that may be processed may vary from these approximations.

A liquid waste (e.g., solvent waste) feed system, such as the solvent waste feed system disclosed in U.S. patent application Ser. No. 10/673,078, filed Sep. 27, 2003, and published on Mar. 31, 2005, as U.S. Published Application No. 2005/0070751, now abandoned, which is incorporated by reference herein, may provide liquid waste to the vessel 900. Solvent waste may be pumpable waste that may pumped from a storage drum, storage tank, and/or retaining pool. Some liquid waste materials may be provided to the vessel 900 through a feeding chamber, such as one included with the solid waste feed system 1104. Alternatively, liquid waste may be injected directly into the vessel 900 through one or more nozzles positioned around a portion of the vessel 900. The liquid waste feed system 1106 may feed liquid waste into the vessel 900 through one or more nozzles from one or more waste sources in an alternating manner, a sequential manner, or at substantially the same time. The nozzles used to introduce the liquid waste into the vessel 900 may be water-cooled spray nozzles. In some waste treatment systems 1100, the liquid waste fed through multiple solvent waste feed nozzles may comprise different types of waste. For example, the solvent waste received from one manufacturing process may be introduced through one nozzle, and solvent waste of a different composition received from a different manufacturing processing may be introduced through another nozzle. The number of solvent waste feed nozzles used, and the manner in which they are employed may vary based upon design and/or application.

Some or all of the solvent waste feed nozzles may be configured to substantially maximize the surface area of the solvent waste. In some designs, this may be accomplished by generating substantially micro-droplets. By substantially maximizing the surface area of the droplet, energy within the vessel 900 may be transferred to the droplets at a substantially greater rate than droplets having a reduced surface area. Maximizing the surface area of the solvent waste droplets may be accomplished by mixing compressed air with the solvent waste in the nozzle. In some systems, liquid waste may be fed into the vessel at a rate of about 250 kg/hr.

Solid and liquid waste may be treated separately or at substantially the same time. To process the waste separately, the solid and liquid waste are separately introduced into the vessel 900. To process the waste at substantially the same time, the solid and liquid waste are introduced into the vessel 900 at substantially the same time or substantially subsequent to one another, such that both solid and liquid waste are in the vessel 900 at a similar time. When the solid and liquid waste are processed at substantially the same time, liquid waste may be introduced into the solid waste feed system 204 to create a homogeneous mix of solid and liquid waste. Alternatively, liquid waste may be introduced into the vessel 900 through the solvent waste feed system 1106 at substantially the same time that solid waste is introduced into the vessel 900 through the solid waste feed system 1104. The waste treatment system 1100 may process equal or non-equal portions of solid and liquid waste.

The desired rate at which waste is fed into the vessel 900 may be dependent on various factors, such as the characteristics of the waste; the energy available from a heating system versus the energy expected to be required for the completion of a molecular dissociation, pyrolysis, and a gasification and melting process; the expected amount of syngas to be generated versus the design capacity of a gas cleaning and conditioning system; and/or the temperature and/or oxygen conditions within the vessel 900. The feed rate may be initially calculated based on: an estimation of the energy required to process the specific waste type being treated, an estimation of the energy required to process the specific waste type being treated, an estimation of the expected quantity of syngas to be produced versus the limitation imposed by the physical size of the plasma reactor (e.g., maintaining a desired residence time in the plasma reactor), or limitations regarding the design capacity of a downstream scrubber system.

Waste fed into the open space of the vessel 900 may be processed by a heating system. The heating system may be positioned within the vessel 900. The heat system may include an electrode holding assembly. The electrode holding assembly may be positioned at the bottom of the vessel 900 such that torch electrodes are elevated compared to the remainder of the vessel 900 bottom and, thus, elevated above a slag pool that may form at the bottom of the vessel 900. The electrode holding assembly may be constructed with insulated material to help transfer heat generated within the electrode holding assembly to the open space of the vessel 900.

The electrode holding assembly may house a pair of graphite electrodes. The pair of electrodes may comprise an anode and cathode that may transfer an arc between them to generate approximately 400 kilowatts.

Inorganic constituents in the waste may be vitrified or melted in the vessel 900. The vitrified or melted inorganic constituents may be removed from the vessel 900 through tap ports 1112 and a tapping process. During non-tapping operations, the tap ports 1112 are closed using water-cooled tap plugs. When tapping is to be initiated, a tap plug is removed from the tap ports 1112 permitting a molten vitrified mixture to flow out of the vessel 900 through the tap ports 1112 and into a collection system 1114. To assist with the removal of the molten vitrified mixture, a non-transferred, water-cooled, direct current plasma torch 1144 may be mounted with the vessel 900 near each tap port 1112. These plasma torches 1144 may be mounted such that an end of the plasma torch 1144 passes into the opening of the vessel 900. The plasma plumes of the plasma torches 1144 may be directed towards the bottom area of the vessel 900 near the tap ports 1112. The plasma torches may be computer controller and may be operated periodically to maintain the fluidity of the molten vitrified material.

In some systems 1100, the tapping plasma torches 1144 may have a capacity of about 15 kilowatts each. The tapping plasma torches 1144 may be positioned at an inclined angle with respect to a wall of the vessel 900, and through the refractory. A water cooled metal enclosure may house the electrodes of the tapping plasma torches. Cooling water for the tapping plasma torches may be supplied from an insulated gate bipolar transistor (IGBT) power supply cooling system positioned downstream in the system. In some systems, the tapping plasma torches may use nitrogen as a torch gas.

The collection system 1114 may include a continuous quenching system that would receive the molten vitrified material that flows out of the tapping ports 1112. The small amount of steam generated by the molten vitrified material may be captured by activated carbon beds that are vented to the outside. The collection system 1114 may also include buckets that would receive the molten vitrified material. Once full, these buckets may be placed inside a quenching tank. Handling of the filed buckets may be accomplished through the use of floor mounted cranes, overhead mounted cranes, forklifts, and/or other lifting apparatuses. The cooled buckets may be removed, and the cooled vitrified material removed and recycled as necessary. When an activated carbon bed of the collection system 1114 is spent, the spent bed may be recycled through the vessel 210.

In some systems, the temperature and/or pressure in the vessel 900 may be continuously or substantially continuously monitored to ensure that negative pressure in the vessel 900 is within a predetermined range. Monitoring of the temperature and/or pressure in the vessel 900 may be through one or more monitoring ports positioned around the vessel 900, and may include the use of one or more sensors in communication with a computerized control system. In some vessels 900, the predetermined negative pressure may range between about −5 mm W.C. to about −10 mm W.C.

The temperature in the vessel 900 may be measured from at least two locations. One location may be in an upper section of the vessel 900, and a second location may be in a lower section of the vessel 900. The electrodes are operated without waste feed until the vessel 900 reaches a minimum temperature of about 1,000 degrees Celsius. This will help to ensure proper dissociation, pyrolysis, and gasification of the organic wastes. Once feeding operations commence, the temperature of the vessel 900 may be increased to a range between approximately 1,000 degrees Celsius to about 1,200 degrees Celsius. The temperature in the vessel 900 may continue to increase during operation, and may approach approximately 1,500 degrees Celsius when vitrification or melting operations commence.

The heating system may have an electrical-to-thermal efficiency greater than about 75 percent, and may not require a pressurized external supply of carrier gas. The system may supply its own gas flow—approximately 5 liters per minute of air per electrode assembly. This small flow of air may also enhance the thermal energy distribution within the vessel 900. The electrode arcs are powered by an insulating gate bipolar transistor (IGBT) power supply. The IGBT power supply may use an input current that is approximately 30 percent less than a silicon controller rectifier system. The IGBT power supply may result in: power factors that are in the range of about 0.97, low harmonic distortion, high arc stability, and/or a smaller control panel.

As a result of the low oxygen environment in the vessel 900, waste received in the vessel 900 may undergo a molecular dissociation and pyrolysis process. Pyrolysis is a process by which intense heat operating in an low oxygen environment dissociates molecules, as contrasted with incineration or burning. During the pyrolysis process, the waste is heated by the heating system. The heated waste may be processed until is dissociates into its elemental components, such as solid carbon (carbon particulate) and hydrogen gas. Oxygen, nitrogen, and halogens (such as chlorine) may also be liberated if present in the waste in the form of a hydrocarbon derivative. After pyrolysis and/or partial oxidation, a resulting syngas including carbon monoxide, hydrogen, carbon dioxide, water vapor, methane, and/or nitrogen may be generated.

In general, dissociated oxygen and chlorine may react with carbon and hydrogen to form a wide array of complex and potentially hazardous organic compounds. Such compounds, however, generally cannot form at the high temperatures within the vessel 210, at which only a limited number of simple compounds may be stable. The most common and stable of these simple compounds are carbon monoxide (formed from a reaction between the free oxygen and carbon particulate), diatomic nitrogen, hydrogen gas, and hydrogen chloride gas (as representative of a hydrogen-halogen gas), when chlorine or other halogens are present.

The amount of oxygen present in the waste material may be insufficient to convert all of the carbon present in the waste material into carbon monoxide gas. Moisture present in the waste material may absorb energy from the high temperature environment in the vessel 900 through a "steam-shift" reaction and form carbon monoxide and hydrogen gas. If an insufficient amount of oxygen or moisture is present in the waste stream and/or as a result of inherent process inefficiencies, unreacted carbon particulates may be entrained in the gas stream and carried out of the vessel 900.

To increase the amount of solid carbon converted to carbon monoxide gas, an additional oxidant may be introduced into the vessel 900. The addition of this oxidant may be into the primary reactor chamber of the vessel 900 and/or secondary reactor chamber of the vessel 900, when present. The waste processing system 1100 may include an oxidant system 1116 that injects an oxidant into the vessel 900 in an amount that facilitates a conversion of some or a substantial portion of the carbon or carbon particulate in the vessel 900 to carbon monoxide. In some systems, the oxidant injection system 900 may be a pressure swing absorption system. The pressure swing absorption system may include a screw air compressor, molecular sieve column, storage tanks, and a local control panel. In some systems 1100, the pressure swing absorption system may have a capacity of about 100 $Nm^3$/hr. The oxidant injection system 1116 may also include oxygen lances to inject additional oxygen into the vessel 900. The oxygen lances may be mounted to the vessel 900, and may inject into the vessel 900 oxygen with a purity in the range of about 90 percent to about 93 percent. Predetermined amounts of the oxidant may be injected into the vessel 900 at one or more locations.

The oxidant injected into the vessel 900 may convert some or a substantial portion of the carbon in the waste or carbon that is dissociated in the vessel 900 as free carbon into carbon monoxide. Because pure carbon is more reactive at the high operating temperatures than the carbon monoxide gas, the additional oxygen may react with the carbon to form carbon monoxide, and not with the carbon monoxide to form carbon dioxide (assuming that the oxidant is not added in excess).

The syngas leaving the vessel 900 may pass through pipe/ductwork and be processed by a wet gas cleaning and conditioning system 1118 that cools down the syngas to a saturation temperature and substantially removes particulate matter and gaseous pollutants. The wet gas cleaning and condition system 1118 includes a high pressure venturi scrubber 1120 which may cool the gas received from the vessel 900 down to less than about 82 degrees Celsius. The venturi scrubber 1120 may cool the received gas through a continuous circulation of a scrubbing liquid from a common scrubber circulation tank 1124 supplied with a pump 1126. Cooling of the syngas in the venturi scrubber 1120 reduces the potential for the re-association of hazardous complex compounds or the formation of new compounds, such as dioxins or furans. The venturi scrubber 1120 may be made of stainless steel with a protective inside lining, and includes a variable throat which allows for maintaining a throat velocity particulate matter removal efficiency.

The venturi scrubber 1120 may be equipped with inlet connected to an emergency water supply. In case of a power or scrubber pump 1126 failure such that circulation through the venturi scrubber is stopped, the inlet valve of the venturi scrubber 1120 may be opened to supply water from the emergency water supply.

Downstream of the venturi scrubber is a counter-current flow packed bed scrubber 1128. The packed bed scrubber 1128 may be used to cool the received gases down to about 55 degrees Celsius, remove entrained particulate matter from the received gases, and absorb acidic gases, such as $H_2S$ and HCl. To aid in the efficient absorption of these gases, the circulation liquid from the scrubber circulation tank 1124 may be maintained at a pH level of about 9 to about 10. This pH level may be maintained by continuous dosing of a caustic solution from a caustic dosing tank. In some systems, a caustic dosing pump may be used to maintain the pH level. At the top of the packed bed scrubber 1128 dry packing is provided which acts as a mist eliminator for gases and entraps entrained liquid droplets from cleaned gases. A washing line may also be provided for dry packing which is operated at regular intervals.

The common scrubber circulation tank 1124 includes a shell and tube-type heat exchanger that maintains the temperature of the circulation liquid at about 50 degrees Celsius. To achieve this temperature, cooling water may be circulated on the shell side of the heat exchanger.

A side stream from the scrubber pump 1126 is continuously circulated through a plate and frame-type filter press to capture particulate matter from the scrubber liquid in the wet gas and conditioning system 1118. Filtrate from the filter press may be brought back to the scrubber circulation tank 1124. Any sludge collected in the filter press may be periodically removed, repacked, and fed back into the vessel 900.

Multiple induced draft fans (ID fans) may be provided in series downstream of the wet gas and conditioning system 1118. In some systems 1100, two ID fans 1132 may be provided. The ID fans 1132 may each be constructed of stainless steel 304 impeller and cased in mild steel rubber lined ("MSRL") or mild steel lined with fiberglass reinforced plastic ("MSFRP") to substantially resist corrosion due to the presence of wet gases. Placement of the ID fans 1132 downstream assists in the creation of negative pressure within the vessel 900 and the rest of the waste treatment system 1100. The ID fans 1132 may also enable a fast response by a variable frequency drive during pressure variations that may occur in the vessel 900 during operation.

A syngas collection tank 1134 may accumulate the cleaned syngas. The syngas collection tank 1134 may have an approximate capacity of about 1.5 $m^3$ and may accumulate the syngas at a pressure of about 1000 mmcg. From the syngas collection tank 1134, the syngas may be processed by a syngas energy recovery system 1136. In some systems 1100, the syngas may be conveyed to the syngas energy recovery system 1136 with a booster fan. The method of processing inorganic and organic waste of FIG. 6 are likewise applicable to the vessel and systems described in FIG. 9-11.

The waste treatment systems described herein may be controlled by a computerized control system located proximate to or at a distance from the waste treatment system. The computerized control system may include one or more processors, memories, (e.g., Random-Access-Memory, Read-Only-Memory, Flash Memory, and/or other optical or digital storage devices) that access or run software application, and network connectivity ports. The computerized control system may be coupled to a computer system and/or server running one or more software programs operating to control the waste treatment system. The computerized control system may receive data transmitted wirelessly or through wired connections from one or more sensors, load cells, detection devices that are configured to provide data relating to the environment in or around the waste treatment system. These data detection devices may detect and/or quantify environmental measurements. Such measurements may include temperature (e.g., a numeric quantification of degree of hotness and/or high or low extremes), toxic chemicals, biohazards, gases (e.g., carbon monoxide, oxygen, methane, etc.), smoke, water, air quality, moisture, weight, and/or pressure. Data transmitted from a data detection device and received at the computerized control system may be retained in a memory and/or database for processing by the computerized control system. The computerized control system may process the data in real or delayed time, and may modify the received and/or retained data to form a new data structure. The new data structure may relate to a statistical analysis of the received and/or retained data.

Some waste treatment systems may utilize a Supervisory Control and Data Acquisition ("SCADA") system, such as the system used by PEAT International, Inc. as its computerized control system. The SCADA system may be configured to run on a computer configured with a Windows operating system, and may provide an operator with a graphical representation and/or control of the waste treatment system. The SCADA system may acquire measurement data about the waste treatment system (e.g., temperature, pressure, current and/or voltage levels of the electrodes, position of the electrodes within the electrode holding assembly, composition of the generated syngas, quantity of waste generated by the waste treatment system, etc.) and automatically adjust a waste feed rate, vessel temperature, oxidant input, gas cleaning and conditioning system, venting, and other subsystems downstream of the vessel. The SCADA system may also control safety, interlocking, and emergency shutdown procedures for each component in the waste treatment system. Alternatively, the SCADA system may prompt a use adjust performance of the system based on the received environmental data. Data retained in the computerized system's memory or databases may be reviewed and analyzed graphically through a display terminal, or through printed form.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A system to treat waste comprising:

a vessel containing a reaction chamber;

a waste feed system configured to feed waste into the reaction chamber of the vessel;

a pair of electrodes spaced apart from one another, each electrode of the pair of electrodes in-line with one another along a horizontal plane and extending into the reaction chamber through opposing side walls of the vessel, and where one electrode of the pair of electrodes is housed on an insulating assembly comprising a sliding platform that has a top layer and a bottom layer.

2. The system of claim 1, where the top layer comprises a material that is different than a material of the bottom layer.

3. The system of claim 1, where the pair of electrodes are positioned above an area of the vessel configured to collected slag resulting from treating waste that is fed into the reaction chamber of the vessel.

4. The system of claim 1, where each of the electrodes comprises a graphite electrode.

5. The system of claim 1, further comprising a motor configured to vary an amount an electrode pair extends into the reaction chamber of the vessel.

6. The system of claim 1, where the electrode pair is accessible from an exterior of the vessel.

7. The system of 1, where the reaction chamber is partially separated from a second reaction chamber by a baffle that extends into an interior of the vessel.

8. The system of claim 1, where the electrode pair comprises an anode and a cathode, and where the insulating assembly further comprises an anode sliding platform constructed of a refractory material that is similar to a refractory material of the bottom of the reaction chamber.

9. The system of claim 8, where the insulating assembly further comprises a cathode sliding platform comprising a material that is different than the refractory material of the bottom of the reaction chamber.

10. The system of claim 9, where the cathode sliding platform comprises a material with low electrical conductivity.

11. The system of claim 8, where the anode comprises one or more replaceable sections, each replaceable section having an end configured to mate with an end of another of the one or more replaceable sections.

12. The system of claim 8, where the cathode comprises one or more replaceable sections, each replaceable section having an end configured to mate with an end of another of the one or more replaceable sections.

* * * * *